US008337237B2

(12) United States Patent
Masuda et al.

(10) Patent No.: US 8,337,237 B2
(45) Date of Patent: Dec. 25, 2012

(54) CONNECTOR DEVICE ADAPTED FOR EASY REPLACEMENT OF A CONTROLLER UNIT IN A CONTROLLER UNIT ARRAY

(75) Inventors: Yasushi Masuda, Shinagawa (JP); Manabu Shimizu, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 122 days.

(21) Appl. No.: 12/730,431

(22) Filed: Mar. 24, 2010

(65) Prior Publication Data

US 2010/0255730 A1 Oct. 7, 2010

(30) Foreign Application Priority Data

Apr. 7, 2009 (JP) ..... 2009-093258

(51) Int. Cl.
*H01R 13/64* (2006.01)

(52) U.S. Cl. ..... 439/374; 439/629; 439/857; 439/928

(58) Field of Classification Search ..... 439/660, 439/682, 374, 928, 929, 626, 79, 629, 857
See application file for complete search history.

(56) References Cited

U.S. PATENT DOCUMENTS

| | | | | | |
|---|---|---|---|---|---|
| 460,725 | A | * | 10/1891 | Markle | 174/88 R |
| 1,835,688 | A | * | 12/1931 | Atwood | 439/642 |
| 2,886,793 | A | * | 5/1959 | Katzman et al. | 439/533 |
| 3,196,377 | A | * | 7/1965 | Minich | 439/60 |
| 3,245,024 | A | * | 4/1966 | Evans | 439/67 |
| 3,299,392 | A | * | 1/1967 | Evans | 439/62 |
| 3,411,130 | A | * | 11/1968 | Bushey | 439/660 |
| 3,629,809 | A | * | 12/1971 | Tillmann et al. | 439/629 |
| 3,816,821 | A | * | 6/1974 | Rhodes | 439/545 |
| 3,995,644 | A | * | 12/1976 | Parsons | 607/116 |
| 4,283,106 | A | * | 8/1981 | Bunnell | 439/571 |
| 4,310,211 | A | * | 1/1982 | Bunnell et al. | 439/358 |
| 4,460,232 | A | * | 7/1984 | Sotolongo | 439/535 |
| 4,475,781 | A | * | 10/1984 | Asick et al. | 439/61 |
| 4,482,938 | A | * | 11/1984 | Norden | 361/823 |
| 4,531,791 | A | * | 7/1985 | Bauchet | 439/108 |
| 4,562,311 | A | * | 12/1985 | Dola | 379/27.08 |
| 4,592,611 | A | * | 6/1986 | Nitschke | 439/345 |
| 4,657,320 | A | * | 4/1987 | Bamford et al. | 439/31 |
| 4,678,121 | A | * | 7/1987 | Douty et al. | 439/607.47 |
| 4,678,264 | A | * | 7/1987 | Bowen et al. | 385/89 |
| 4,772,211 | A | * | 9/1988 | Asick et al. | 439/65 |

(Continued)

FOREIGN PATENT DOCUMENTS

CH 580342 * 9/1976

*Primary Examiner* — Neil Abrams
(74) *Attorney, Agent, or Firm* — IPUSA, PLLC

(57) ABSTRACT

A connector device includes a male connector and a female connector attached to and detached from each other by moving the male connector in a sliding direction relative to the female connector, the male connector including plug electrodes arrayed in an arraying direction perpendicular to the sliding direction, each plug electrode including a curved part formed at one end and bent in the arraying direction, and the female connector including jack electrodes arrayed in the arraying direction, each jack electrode corresponding to one of the plug electrodes and including a connection formed at one end and projecting in a direction parallel to the sliding direction, each connection including two resilient terminal portions, and when the male connector and the female connector are mutually fitted to each other, the curved part of each plug electrode is inserted and fitted between the two resilient terminal portions of a corresponding jack electrode.

12 Claims, 26 Drawing Sheets

U.S. PATENT DOCUMENTS 4,790,762 A * 12/1988 Harms et al. ..... 439/59
4,795,379 A * 1/1989 Sasaki et al. ..... 439/856
4,902,943 A * 2/1990 Nicholson et al. ..... 315/289
5,187,422 A * 2/1993 Izenbaard et al. ..... 320/110
5,201,663 A * 4/1993 Kikuchi et al. ..... 439/83
5,304,077 A * 4/1994 Provenzale ..... 439/347
5,306,168 A * 4/1994 Kunishi et al. ..... 439/248
5,340,327 A * 8/1994 Koda ..... 439/239
5,486,118 A * 1/1996 Colleran et al. ..... 439/374
5,586,901 A * 12/1996 Muta ..... 439/342
5,641,313 A * 6/1997 Hohorst ..... 439/709
5,716,241 A 2/1998 Hennemann et al.
5,727,961 A * 3/1998 Landis et al. ..... 439/287
5,741,161 A * 4/1998 Cahaly et al. ..... 439/709
5,971,784 A * 10/1999 Fabian et al. ..... 439/224
6,018,227 A * 1/2000 Kumar et al. ..... 320/106
6,027,379 A * 2/2000 Hohorst ..... 439/715
6,121,753 A * 9/2000 Walker et al. ..... 320/132
6,172,877 B1 * 1/2001 Feye-Hohmann et al. ... 361/759
6,350,149 B1 * 2/2002 Nakane ..... 439/500
6,350,154 B1 * 2/2002 Fu ..... 439/638
6,418,027 B1 * 7/2002 Suzuki et al. ..... 361/729
6,425,770 B1 * 7/2002 Lostoski et al. ..... 439/76.1
6,457,980 B2 * 10/2002 Hattori et al. ..... 439/74
6,461,178 B1 * 10/2002 Fu ..... 439/224
6,551,143 B2 * 4/2003 Tanaka et al. ..... 439/682
6,644,980 B2 * 11/2003 Kameda ..... 439/65
6,783,403 B2 * 8/2004 Lafragette et al. ..... 439/717
6,908,345 B2 * 6/2005 Shimizu et al. ..... 439/682
7,011,543 B2 * 3/2006 Hiramoto et al. ..... 439/405
7,048,555 B2 * 5/2006 Ono ..... 439/83
7,118,424 B2 * 10/2006 Masaki et al. ..... 439/682
7,147,487 B2 * 12/2006 Barbion ..... 439/79
7,243,734 B2 * 7/2007 Wu ..... 173/217
7,549,892 B2 * 6/2009 Sawyers et al. ..... 439/500
7,609,528 B2 * 10/2009 Freimuth et al. ..... 361/801
7,769,413 B2 * 8/2010 Simoes et al. ..... 455/573
7,802,994 B1 * 9/2010 Chen et al. ..... 439/65
7,862,360 B2 * 1/2011 Wang ..... 439/326
7,896,710 B2 * 3/2011 Deylitz et al. ..... 439/682
2001/0043882 A1 * 11/2001 Berger et al. ..... 422/67
2005/0226741 A1 * 10/2005 Huang ..... 417/411
2010/0255730 A1 * 10/2010 Masuda et al. ..... 439/660

* cited by examiner

CONNECTOR DEVICE ADAPTED FOR EASY REPLACEMENT OF A CONTROLLER UNIT IN A CONTROLLER UNIT ARRAY

BACKGROUND OF THE INVENTION

1. Field of the Invention

This invention relates to a connector device which is used for connection of PLC (programmable logic controller) units in an electronic device.

2. Description of the Related Art

An electronic device, such as an FA (factory automation) device, is known which includes two or more box-type modules called PLC (programmable logic controller) units arrayed in a row and connected together. In the PLC units, functional electronic circuits are incorporated respectively. The PLC units are arrayed in a row and connected together in order to construct the electronic device (or the FA device) which provides a desired function.

Each PLC unit is provided with connectors each including connection terminals. For example, the methods of connection of PLC units according to the related art may be classified into a stacking structure method and a back-board structure method.

FIG. 1 is a diagram for explaining a stacking structure method according to the related art. As illustrated in FIG. 1, in this method, a connector 112 is formed on the side of each of the PLC units 111, and the PLC units 111 are arranged side by side in the direction indicated by the arrow A1 in FIG. 1. Two adjacent ones of the PLC units 111 are detachably connected to each other by means of the connector 112. All of the PLC units 111 are connected together to construct an FA device providing a desired function.

In the case of the stacking structure method, if the FA device is large in size, the number of PLC units 111 arranged in the FA device increases. If a failure of the PLC unit located in the middle of the PLC unit array arises, it is difficult to remove the defective PLC unit from the PLC unit array and replace it with a new PLC unit, and such replacement work requires some time and effort.

FIG. 2 is a diagram for explaining a back-board structure method according to the related art. As illustrated in FIG. 2, in this method, a connector is formed on the back surface of each of PLC units 121, and connectors are formed on a back board 122 which is arranged on the back of the PLC units 121. The connectors on the back surfaces of the PLC units 121 and the connectors on the back board 122 are respectively connected together to construct the FA device in which the PLC units are connected together. By moving one of the PLC units 121 in the direction indicated by the arrow A2 in FIG. 2, the PLC unit may be detached from the back board 122.

In the case of the back-board structure method, the number of PLC units 121 that can be arranged in the FA device depends on the size of the back board 122 and is restricted. The back-board structure method has a problem in that the extendibility of PLC units is limited which puts restrictions on the advantage of using the PLC units 121.

As an electronic device according to the related art, Japanese Patent No. 3579803 discloses an input/output module which can be located on a support rail and used for connection of bus terminal blocks.

SUMMARY OF THE INVENTION

In one aspect of the invention, the present disclosure provides a connector device which is used for connection of PLC units in an electronic device and enables easy replacement of a defective PLC unit in the middle of the PLC unit array, without restricting the number of PLC units arranged in the electronic device.

In an embodiment of the invention which solves or reduces one or more of the above-mentioned problems, the present disclosure provides a connector device including a male connector and a female connector, wherein the male connector includes a plurality of plug electrodes disposed in the male connector and arrayed in a row extending in a first arraying direction perpendicular to an attaching or detaching direction of the connector device, each plug electrode including a curved part formed at one end of the plug electrode and bent in the first arraying direction along a line parallel to the attaching or detaching direction; the female connector includes a plurality of jack electrodes disposed in the female connector and arrayed in a row extending in a second arraying direction perpendicular to the attaching or detaching direction, each jack electrode including a connection part formed at one end of the jack electrode and projecting in a direction parallel to the attaching or detaching direction, the connection part including two resilient terminal portions projecting from a support portion in a bifurcated manner; and the connector device is arranged so that, when the male connector and the female connector are mutually slid in the attaching or detaching direction and fitted to each other, the curved part of each plug electrode is inserted and fitted between the two resilient terminal portions of a corresponding one of the plurality of jack electrodes, and the plurality of plug electrodes and the plurality of jack electrodes are electrically connected to each other.

In an embodiment of the invention which solves or reduces one or more of the above-mentioned problems, the present disclosure provides a connector device including a male connector and a female connector, wherein the male connector includes a plurality of plug electrodes disposed in the male connector and arrayed in a row extending in a first arraying direction perpendicular to an attaching or detaching direction of the connector device, each plug electrode including a contact part formed at one end of the plug electrode; the female connector includes a plurality of jack electrodes disposed in the female connector and arrayed in a row extending in a second arraying direction perpendicular to the attaching or detaching direction, each jack electrode including a connection part formed at one end of the jack electrode and projecting in a direction parallel to the attaching or detaching direction, the connection part including two resilient terminal portions projecting from a support portion in a bifurcated manner; and the connector device is arranged so that, when the male connector and the female connector are mutually slid in the attaching or detaching direction and fitted to each other, the contact part of each plug electrode is inserted and fitted between the two resilient terminal portions of a corresponding one of the plurality of jack electrodes, and the plurality of plug electrodes and the plurality of jack electrodes are electrically connected to each other.

DETAILED DESCRIPTION OF THE PREFERED EMBODIMENTS

A description will be given of embodiments of the invention with reference to the drawings.

First, a connector device of a first embodiment of the invention will be described. This connector device includes a male connector (plug connector) and a female connector (jack connector).

With reference to FIGS. 3 to 6, the male connector and the female connector in this embodiment will be described.

Figure 1:
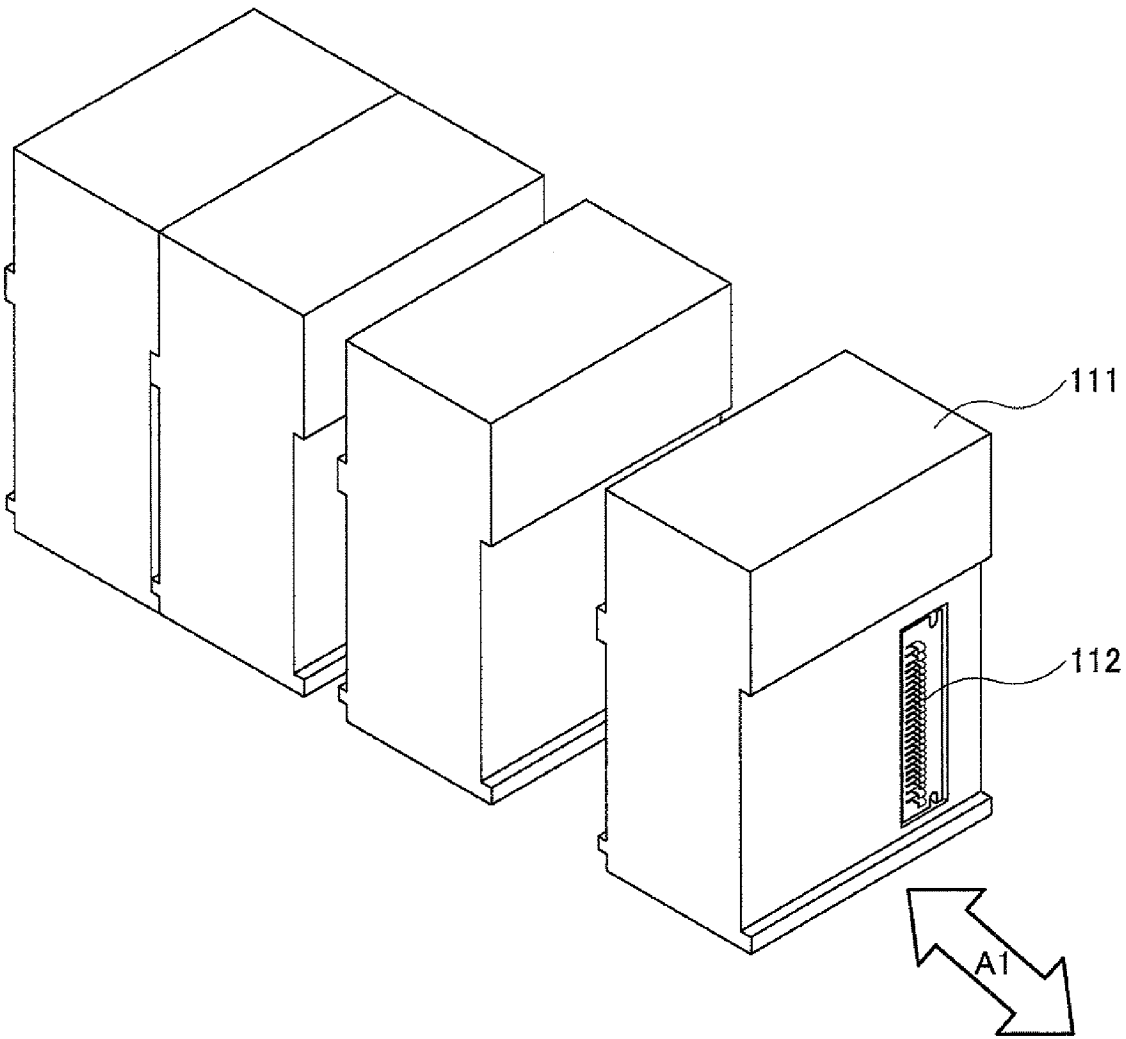
FIG.1 RELATED ART
FIG. 1 is a perspective view for explaining a method of connection of PLC units according to the related art.
Figure 2:
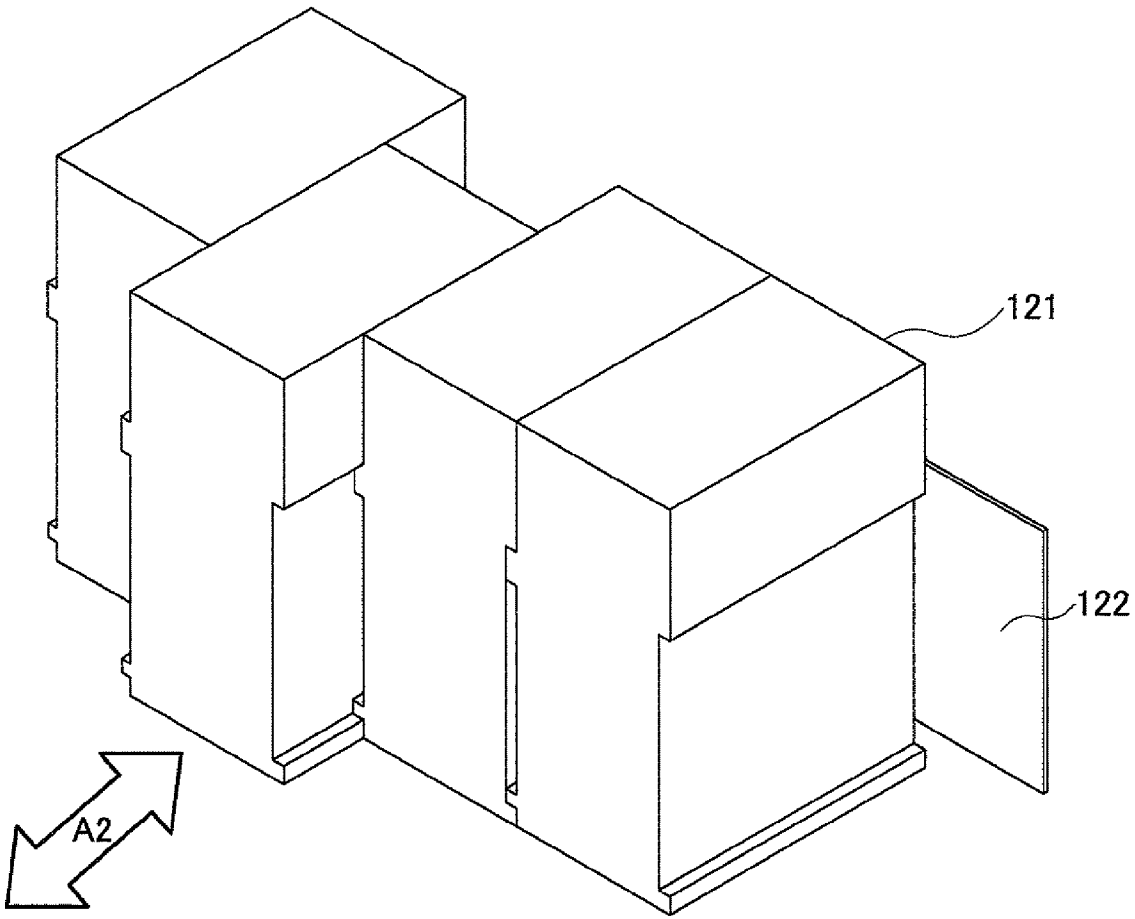
FIG.2 RELATED ART
FIG. 2 is a perspective view for explaining a method of connection of PLC units according to the related art.
Figure 3:
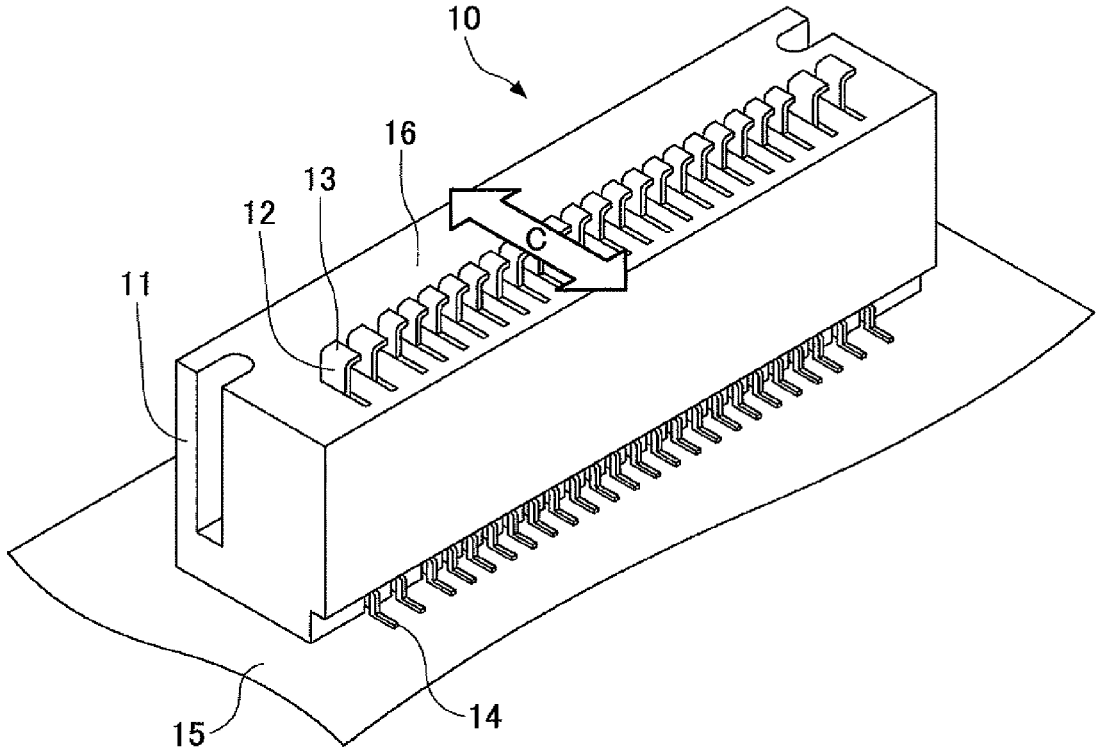
FIG. 3 is a perspective view of a male connector in a connector device of a first embodiment of the invention.
Figure 4:
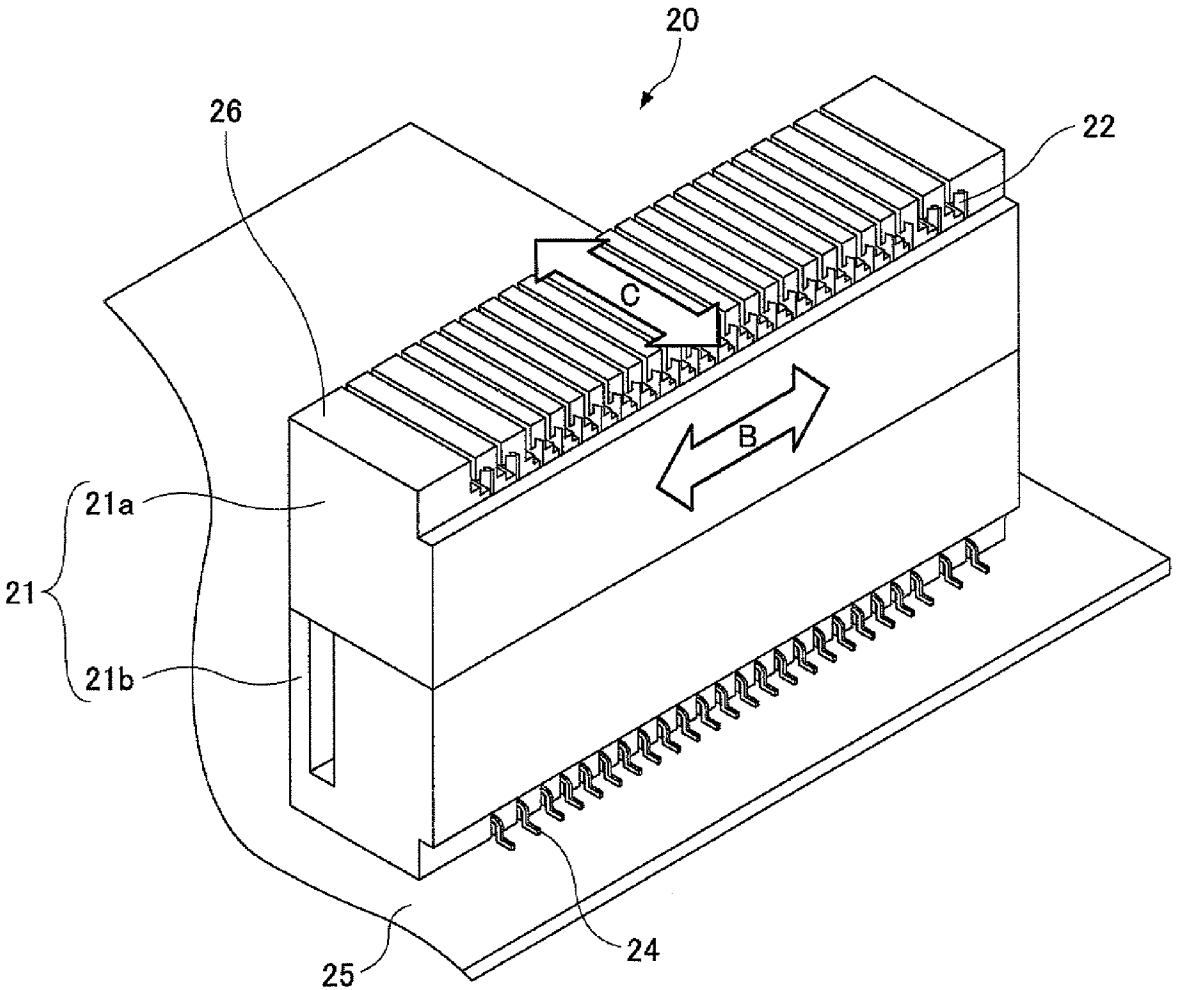
FIG. 4 is a perspective view of a female connector in the connector device of the first embodiment.
Figure 5:
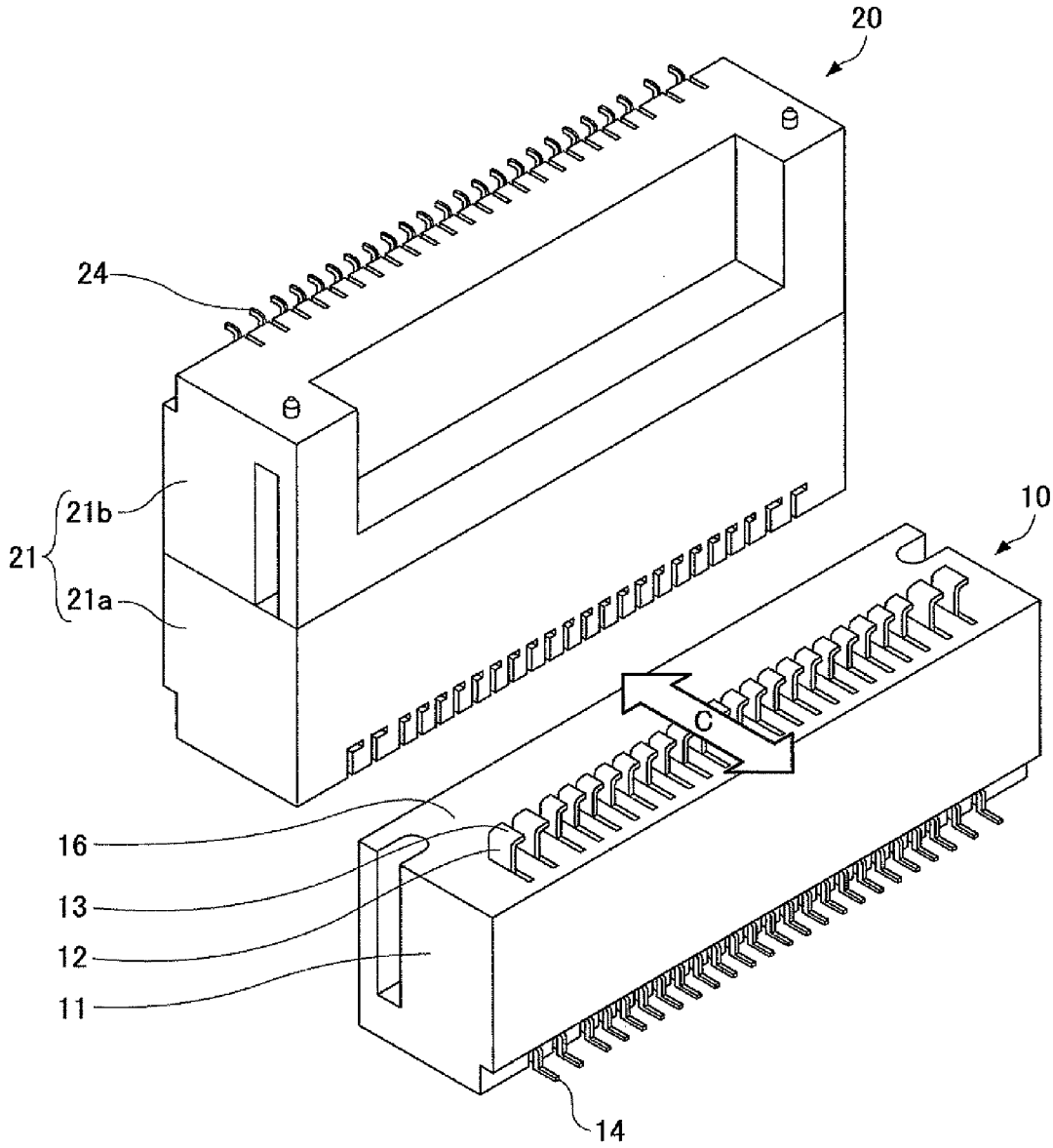
FIG. 5 is a diagram for explaining a fitting method of the male connector and the female connector in the first embodiment.
Figure 6:
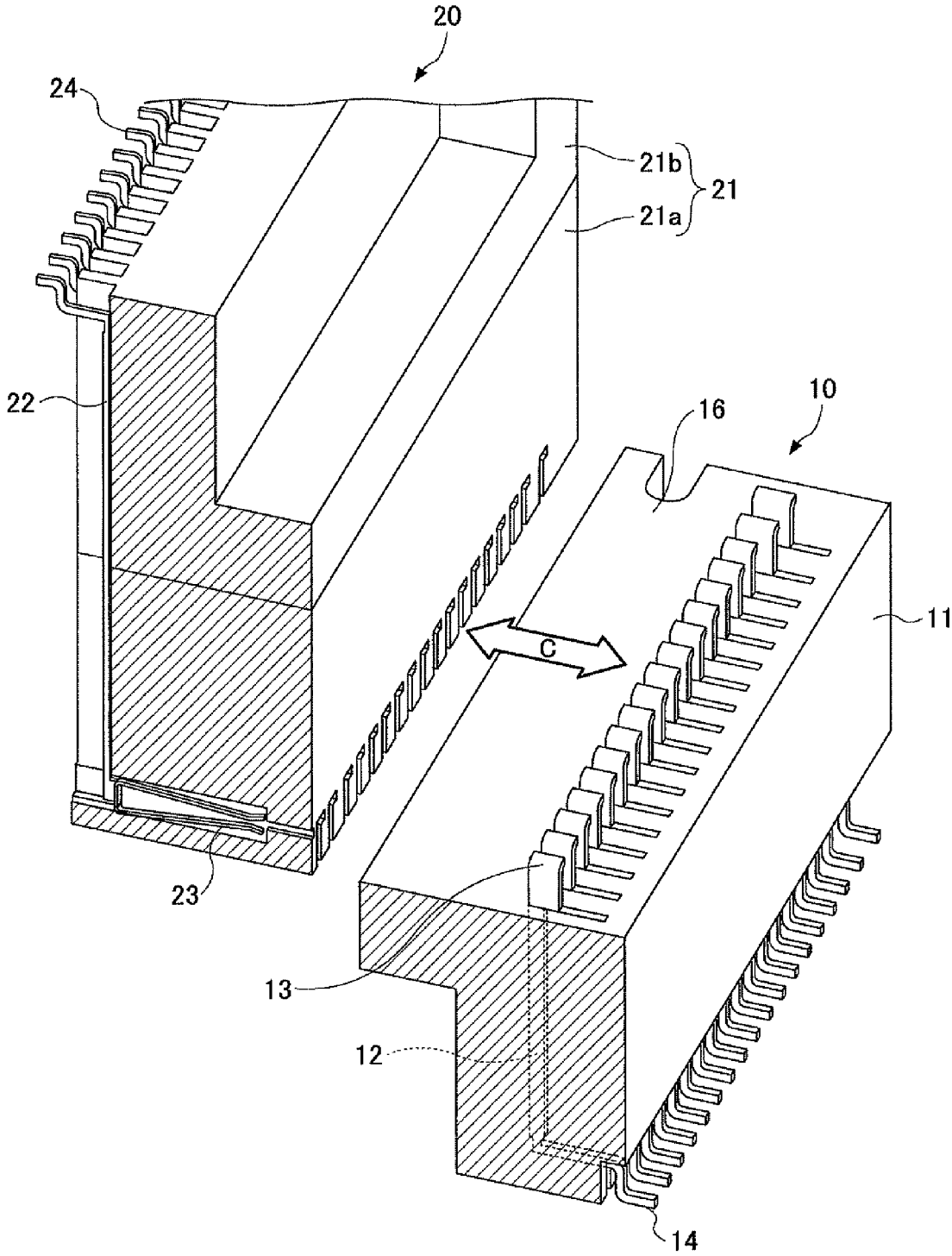
FIG. 6 is a perspective view of a cross section of each of the male connector and the female connector in the first embodiment.

FIG. 3 is a perspective view of the male connector (plug connector) in this embodiment, FIG. 4 is a perspective view of the female connector (jack connector) in this embodiment, FIG. 5 is a diagram for explaining a fitting condition of the male connector and the female connector in this embodiment, and FIG. 6 is a perspective view illustrating a cross section of each of the male connector and the female connector in this embodiment.

The male connector 10 in this embodiment includes a body part 11, and a plurality of plug electrodes 12 disposed in the body part 11. The body part 11 is formed of an insulating material, such as a resin material. Each plug electrode 12 has a curved part 13 at one end of the plug electrode 12, and a connection terminal 14 at the other end of the plug electrode 12. The curved part 13 is formed to enable the plug electrode 12 to be connected with a female connector 20 (which will be described below). The connection terminal 14 is formed to enable the plug electrode 12 to be electrically connected with a substrate 15.

The female connector 20 in this embodiment includes a body part 21, and a plurality of jack electrodes 22 disposed in the body part 21. The body part 21 is formed of an insulating material, such as a resin material. Each jack electrode 22 has a connection part 23 at one end of the jack electrode 22, and a connection terminal 24 at the other end of the jack electrode 22. The connection part 23 is formed to enable the jack electrode 22 to be connected with the curved part 13 of a corresponding plug electrode 12 of the male connector 10. The connection terminal 24 is formed to enable the jack electrode 22 to be electrically connected with a substrate 25.

The body part 21 is divided into an upper main part 21*a* and a lower main part 21*b* which are coupled together by the plurality of jack electrodes 22, one end of each jack electrode 22 of the female connector 20 located in the lower main part 21*b* is connected with the substrate 25, and the other end of each jack electrode 22 of the female connector 20 located in the upper main part 21*a* is connected to the corresponding one of the plurality of plug electrodes 12 of the male connector 10. When the female connector 20 is connected to the male connector 10, the connection parts 23 of the jack electrodes 22 provided inside the upper main part 21*a* are respectively connected with the curved parts 13 of the plug electrodes 12 provided on the male connector 10. The female connector 20 in this embodiment is arranged so that the upper main part 21*a* is slightly movable to the lower main part 21*b* in the direction indicated by the arrow B in FIG. 4.

In the male connector 10, the plug electrodes 12 are press fitted in the body part 11 formed of the insulating material, such as a resin material. Thereafter, the plug electrodes 12 are protected by a cover of the insulating material (resin material) which is injected from the direction of press fitting. Similarly, in the female connector 20, the jack electrodes 22 are press fitted in the body part 21 of the insulating material, such as a resin material. Thereafter, the jack electrodes are protected by a cover of the insulating material (resin material) which is injected from the direction of press fitting. The use of these covers makes it possible to control the impedance of each of the male connector 10 and the female connector 20.

In this embodiment, when the male connector 10 and the female connector 20 are to be connected together, a contact surface 16 of the body part 11 of the male connector 10 and a contact surface 26 of the body part 21 of the female connector 20 are in contact with each other at their end portions, and the female connector 20 is moved (or slid) relative to the male connector 10 in a direction indicated by the arrow C in FIG. 5 or FIG. 6 (which direction will be called an attaching or detaching direction), so that the male connector 10 and the female connector 20 are fitted and connected together. The above fitting operation may be performed bi-directionally by moving the female connector 20 relative to the male connector 10 in either a forward direction parallel to the direction indicated by the arrow C or a backward direction parallel to the direction indicated by the arrow C.

Figure 7:
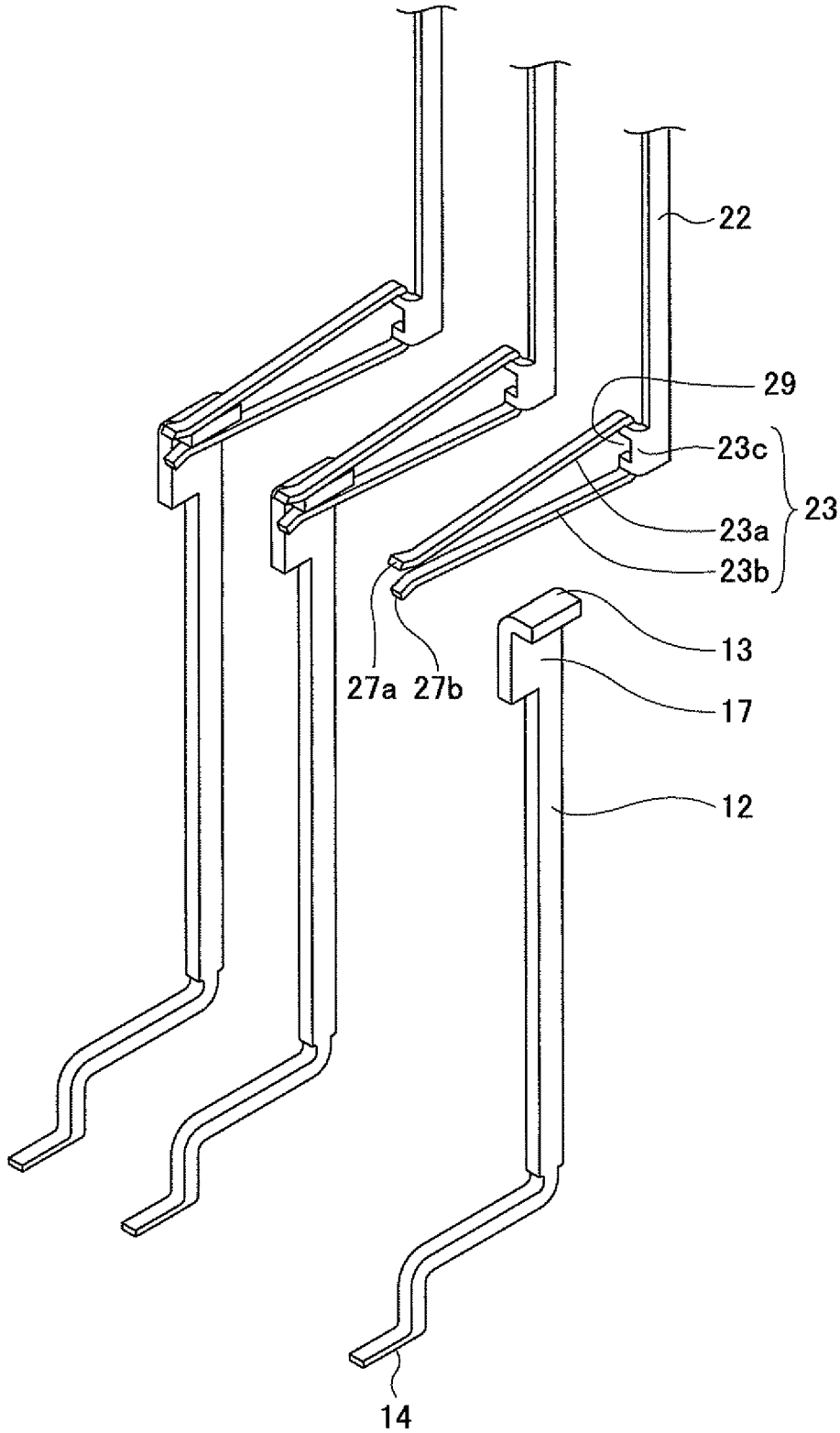
FIG. 7 is a diagram for explaining a fitting method of a plug electrode and a jack electrode in the first embodiment.

Next, with reference to FIGS. 7 to 9, the plug electrodes 12 of the male connector 10 and the jack electrodes 22 of the female connector 20 in this embodiment will be described.

Each of the plurality of plug electrodes 12 of the male connector 10 in this embodiment is formed of a conductive material, such as a metal. Each plug electrode 12 includes a wide part 17 formed at one end, and an end portion of the wide part 17 is bent to form a curved part 13. Each plug electrode 12 includes a connection terminal 14 formed at the other end thereof.

The plurality of plug electrodes 12 inside the body part 11 are in an upright position in a direction substantially perpendicular to the surface of the substrate 15, and arrayed in a row extending in an arraying direction that is perpendicular to the attaching or detaching direction indicated by the arrow C.

The curved part 13 of each plug electrode 12 is bent in the arraying direction (in which the plurality of plug electrodes 12 are arrayed) along a line parallel to the attaching or detaching direction indicated by the arrow C. The curved part 13 of each plug electrode 12 is formed by bending the end portion of the wide part 17, and the width of the curved part 13 in the direction C is larger than the widths of other portions of the plug electrode 12. Thereby, even if the male connector 10 and the female connector 20 are placed with a slight misalignment, the plug electrodes 12 of the male connector 10 and the jack electrodes 22 of the female connector 20 can be electrically connected to each other securely. The connection terminal 14 at the other end of each plug electrode 12 is bent at its end portion in a direction that is parallel to the surface of the substrate 15. Thereby, the plurality of plug electrodes 12 of the male connector 10 can be electrically connected to the electrodes provided on the substrate 15 securely with a low resistance.

Each of the plurality of jack electrodes 22 of the female connector 20 in this embodiment is formed of a conductive material, such as a metal. Each jack electrode 22 includes a connection part 23 formed at one end thereof, and a connection terminal 24 formed at the other end thereof.

The plurality of jack electrodes 22 inside the body part 21 are in an upright position in a direction that is substantially perpendicular to the substrate 25, and arrayed in a row extending in an arraying direction that is perpendicular to the attaching or detaching direction indicated by the arrow C.

The connection part 23 of each jack electrode 22 includes a support portion 23*c* from which two terminal portions 23*a* and 23*b* project in a bifurcated manner, and the terminal portions 23*a* and 23*b* project from the support portion 23*c* in the attaching or detaching direction indicated by the arrow C, which direction is perpendicular to the arraying direction in which the plurality of jack electrodes 22 are arrayed in a row.

Both the terminal portion 23*a* and the terminal portion 23*b* are resilient, and when an external force is exerted, the internal gap between the terminal portion 23*a* and the terminal portion 23*b* is increased by the external force. Both end portions 27*a* and 27*b* of the terminal portions 23*a* and 23*b* are outwardly curved so that the curved part 13 of each plug electrode 12 can be easily inserted in the internal gap between the terminal portions 23*a* and 23*b* via the outwardly curved end portions 27*a* and 27*b*.

When the female connector 20 is moved (or slid) relative to the male connector 10 in the direction indicated by the arrow C in order to fit the female connector 20 in the male connector 10, the curved part 13 of each plug electrode 12 of the male connector 10 is first engaged with the end portions 27*a* and 27*b* of each jack electrode 22 of the female connector 20, and then inserted in the internal gap between the terminal portion 23*a* and the terminal portion 23*b*. The terminal portion 23*a* and the terminal portion 23*b* includes a contact part 28*a* and a contact part 28*b*, respectively, in which the internal gap between the terminal portion 23*a* and the terminal portion 23*b* is narrowed.

Figure 8:
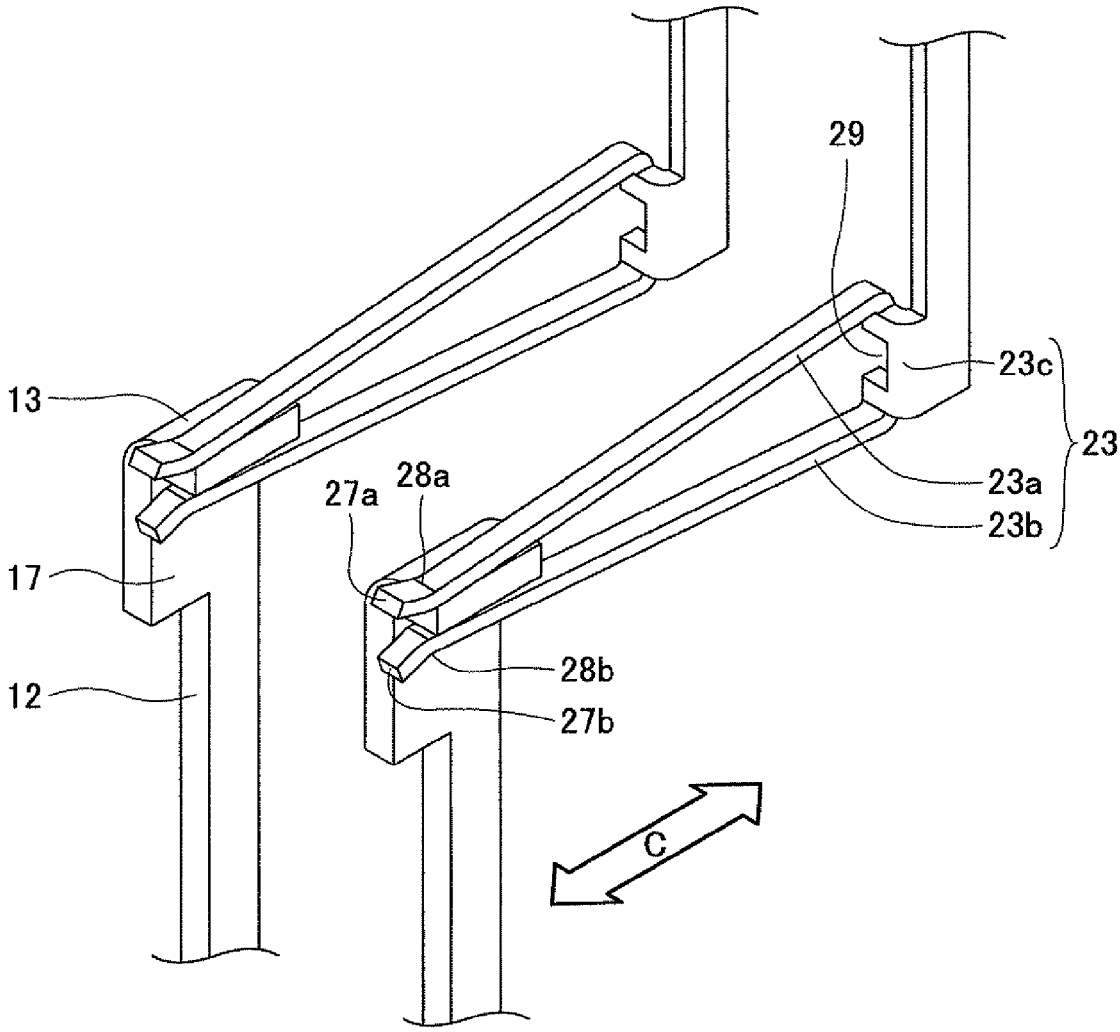
FIG. 8 is a diagram for explaining the fitting method of the plug electrode and the jack electrode in the first embodiment.

As illustrated in FIG. 8, the curved part 13 of the plug electrode 12 is contacted and fitted in these contact parts 28*a* and 28*b*, so that the plug electrode 12 and the jack electrode 22 are electrically connected with each other.

Figure 9:
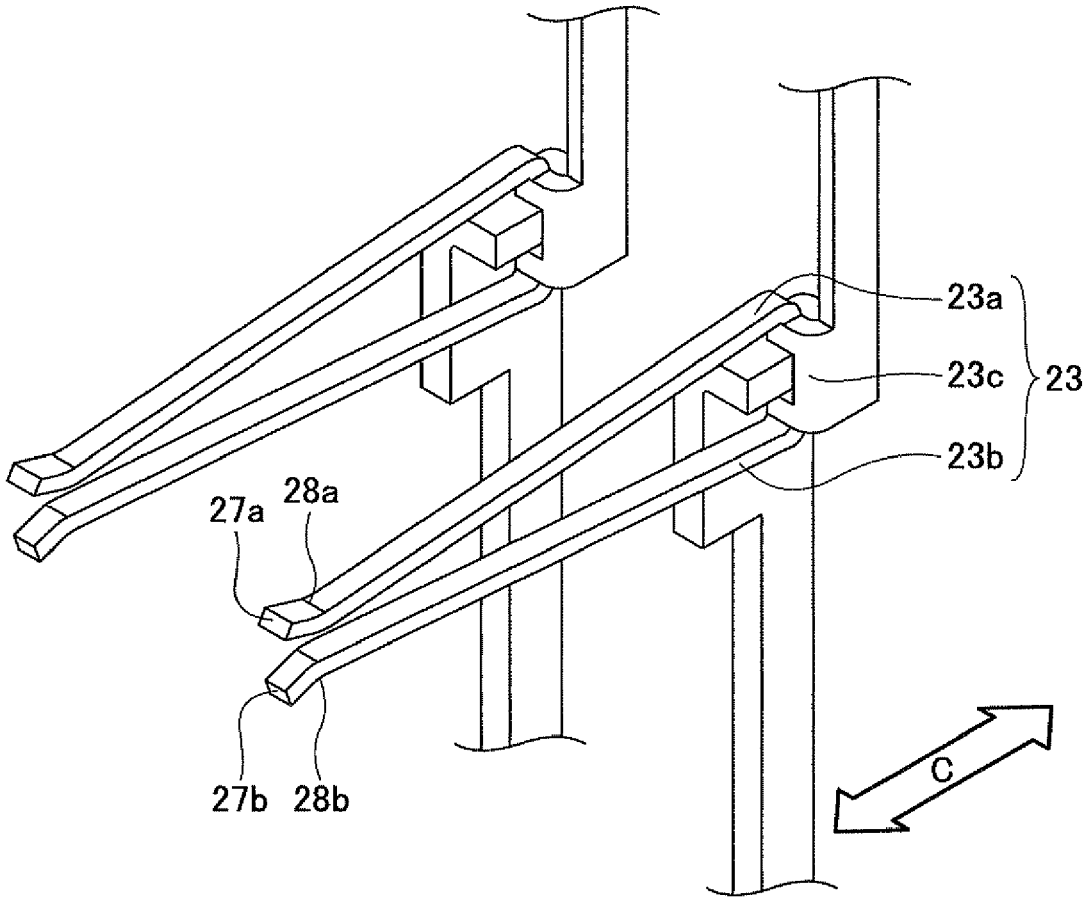
FIG. 9 is a diagram for explaining the fitting method of the plug electrode and the jack electrode in the first embodiment.

Subsequently, if the female connector 20 is further moved relative to the male connector 10 in the direction indicated by the arrow C, as illustrated in FIG. 9, the curved part 13 of the plug electrode 12 passes through the internal gap between the terminal portion 23*a* and the terminal portion 23*b* and passes through a groove 29 formed in the support portion 23*c*, so that the curved part 13 of the plug electrode 12 is disconnected from the connection part 23 of the jack electrode 22.

When fitting the female connector 20 in the male connector 10 again, the female connector 20 is moved relative to the male connector 10 in the reverse direction that is opposite to the above-mentioned direction C, and the curved part 13 of the plug electrode 12 is inserted in the internal gap between the terminal portion 23*a* and the terminal portion 23*b* from the groove 29 formed in the support portion 23*c*. In this case, if the female connector 20 is further moved backward relative to the male connector 10, the curved part 13 of the plug electrode 12 may be fitted in the contact parts 28*a* and 28*b* of the jack electrode 22. Thereby, the plug electrode 12 and the jack electrode 22 can be connected electrically.

Next, with reference to FIGS. 10 and 11, a method of connection of the PLC units using the connector device of this embodiment will be described.

Figure 10:
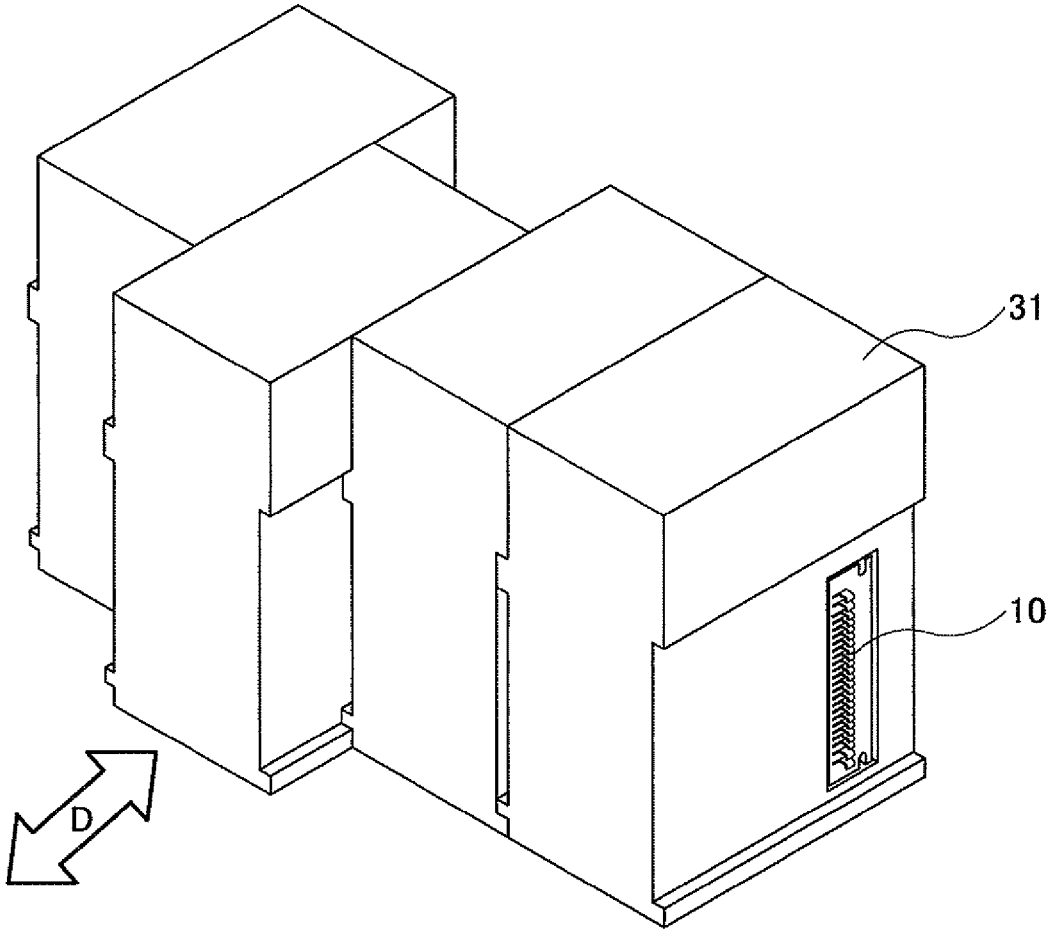
FIG. 10 is a diagram for explaining a method of connection of PLC units using the connector device of the first embodiment.
Figure 11:
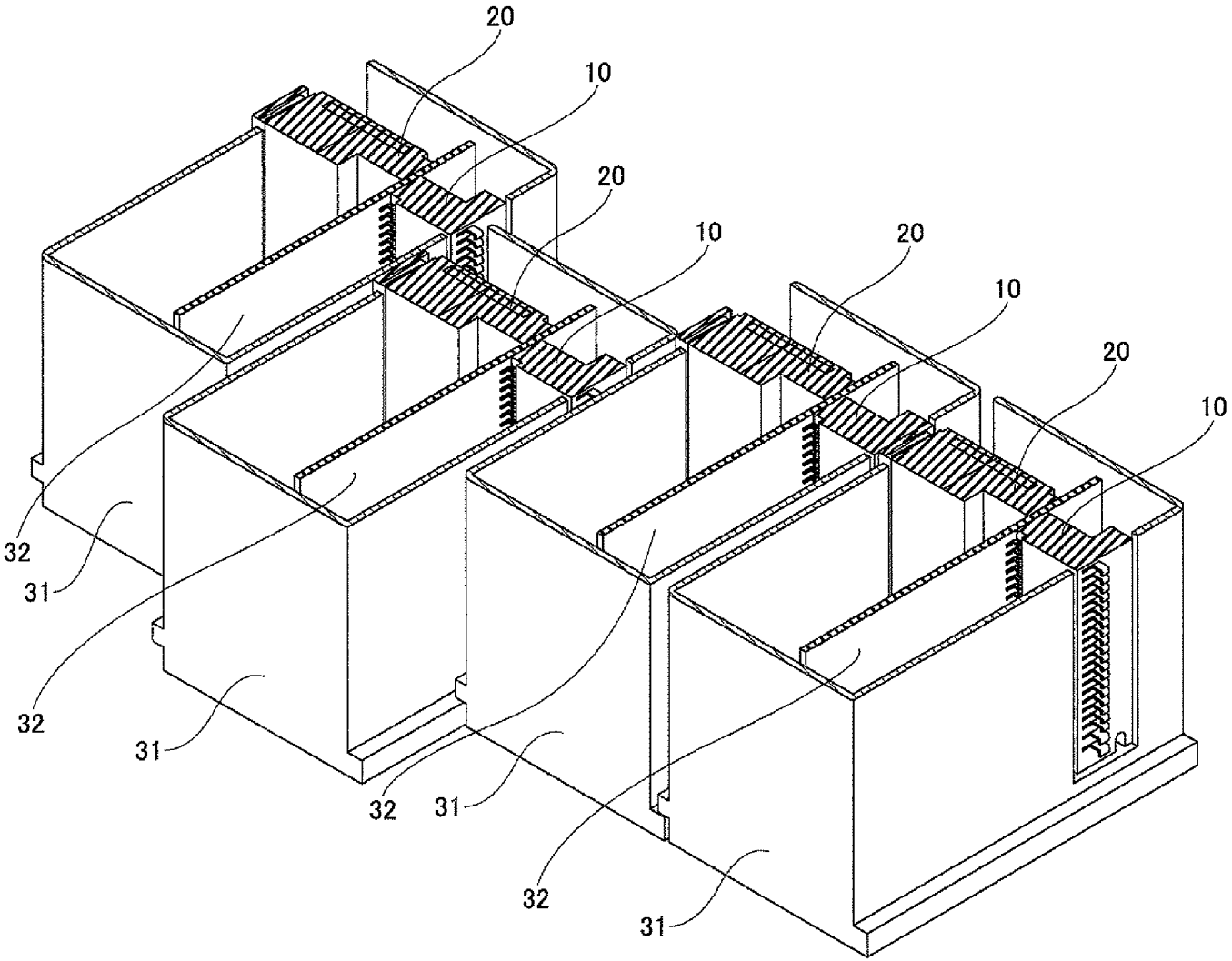
FIG. 11 is a diagram for explaining the method of connection of PLC units using the connector device of the first embodiment.

As illustrated in FIGS. 10 and 11, the above-described male connector 10 and the above-described female connector 20 are arranged in each of the PLC units 31. Both the male connector 10 and the female connector 20 are mounted on a substrate 32 of each PLC unit 31, the male connector 10 being disposed on one of the two opposing side faces of the PLC unit 31, and the female connector 20 being disposed on the other of the two opposing side faces of the PLC 31.

If a PLC unit 31 located in the middle of the PLC unit array is slid to (or displaced from) the PLC unit array in the direction indicated by the arrow D in FIG. 10, the male connector 10 and the female connector 20 may be fitted and connected (or unfitted and disconnected), and the PLC unit 31 may be connected to (or disconnected from) the neighboring ones of the PLC unit array. It should be noted that the direction D as illustrated in FIG. 10 is equivalent to and parallel to the attaching or detaching direction C as illustrated in FIG. 5 or FIG. 6.

Unlike the case of the stacking structure method according to the related art, if the connector device of this embodiment is used, even when a failure of a PLC unit located in the middle of the PLC unit array arises, only the defective PLC unit may be moved in the direction indicated by the arrow D and easily removed from the PLC unit array for replacement of the defective PLC unit with a new one. Unlike the case of the back-board structure method according to the related art, if the connecter device of this embodiment is used, it is possible to easily replace the defective PLC unit with a new PLC unit in a short time without restricting the number of PLC units arranged in the FA device.

Next, a connector device of a second embodiment of the invention will be described.

The male connector in the connector device of this embodiment is the same as that in the first embodiment, and the composition of the jack electrodes of the female connector in this embodiment differs from that in the first embodiment.

Figure 12:
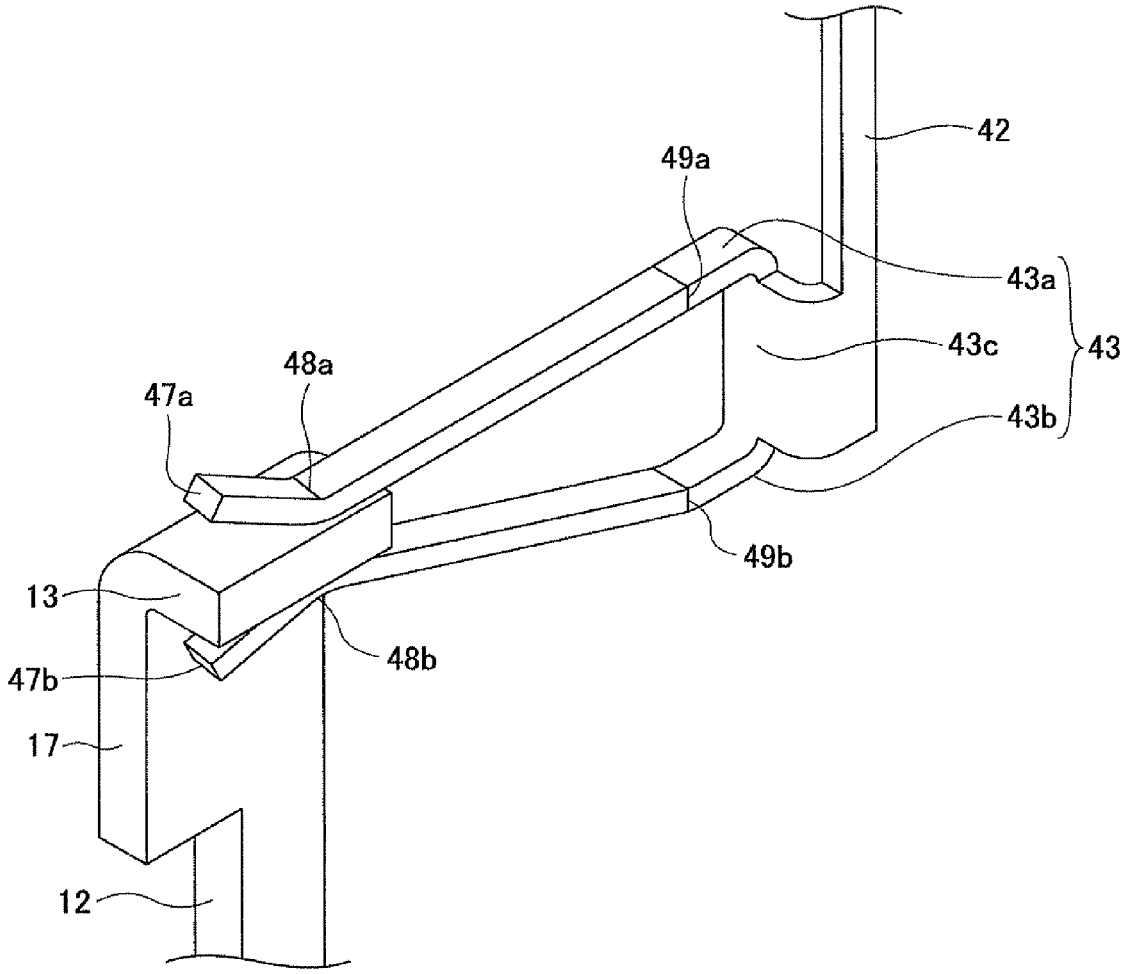
FIG. 12 is a perspective view illustrating the fitting condition of a plug electrode and a jack electrode in a connector device of a second embodiment of the invention.
Figure 13:
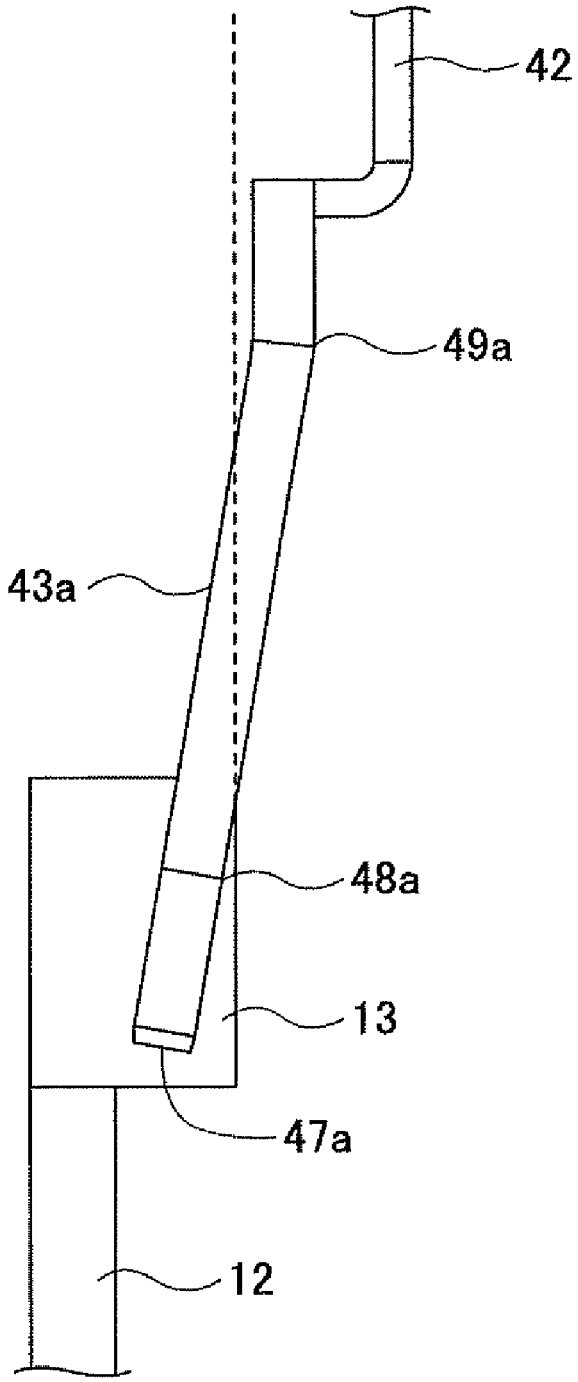
FIG. 13 is a top view illustrating the fitting condition of the plug electrode and the jack electrode in the second embodiment.
Figure 14:
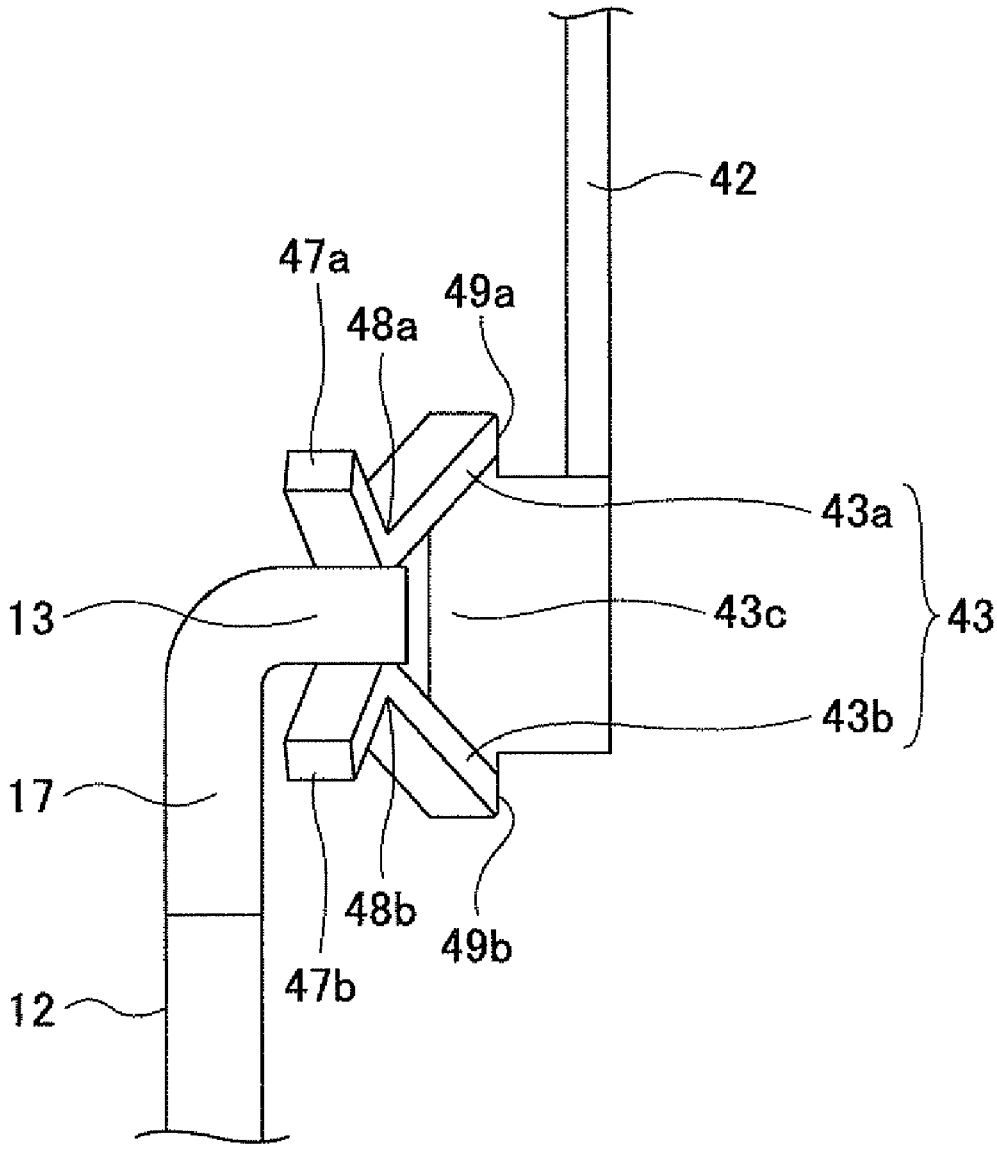
FIG. 14 is a front view illustrating the fitting condition of the plug electrode and the jack electrode in the second embodiment.

With reference to FIGS. 12 to 14, the female connector in this embodiment will be described. Each of the plurality of jack electrodes 42 of the female connector in this embodiment is formed of a conductive material, such as a metal. Each jack electrode 42 includes a connection part 43 formed at one end thereof, and a connection terminal formed at the other end thereof (not illustrated).

The connection part 43 of each jack electrode 42 includes a support portion 43*c* from which two terminal portions 43*a* and 43*b* project in a bifurcated manner, and the terminal portions 43*a* and 43*b* project from the support portion 43*c* in the attaching or detaching direction C, similar to those in the first embodiment.

Both the terminal portion 43*a* and the terminal portion 43*b* are resilient, and when an external force is exerted, the internal gap between the terminal portion 43*a* and the terminal portion 43*b* is easily increased by the external force. Both end portions 47*a* and 47*b* of the terminal portions 43*a* and 43*b* are outwardly curved so that the curved part 13 of each plug electrode 12 of the male connector can be easily inserted in the internal gap between the terminal portions 43*a* and 43*b* via the outwardly curved end portions 47*a* and 47*b*.

The terminal portion 43*a* and the terminal portion 43*b* include a contact part 48*a* and a contact part 48*b*, respectively, where the internal gap between the terminal portion 43*a* and the terminal portion 43*b* is narrowed. The terminal portion 43*a* and the terminal portion 43*b* include a terminal curved part 49*a* and a terminal curved part 49*b*, respectively, where the terminal portion 43*a* and the terminal portion 43*b* are bent inwardly and slantingly toward the side of the wide part 17 of the plug electrode 12 in which the curved part 13 is formed. Thereby, each jack electrode 42 of the female connector in this embodiment is arranged so that the curved part 13 of each plug electrode 12 can easily pass through the neighborhood of the support portion 43*c*, without forming a groove in the support portion 43*c* as illustrated in the first embodiment. Accordingly, the curved part 13 of each plug electrode 12 can easily pass through the internal gap between the terminal portion 43*a* and the terminal portion 43*b* bi-directionally.

Other compositions of this embodiment than those described above are the same as those of the first embodiment, and a description thereof will be omitted.

Next, a connector device of a third embodiment of the invention will be described.

The male connector in the connector device of this embodiment is the same as that in the first embodiment, and the composition of the jack electrodes of the female connector in this embodiment differs from that in the first embodiment.

Figure 15:
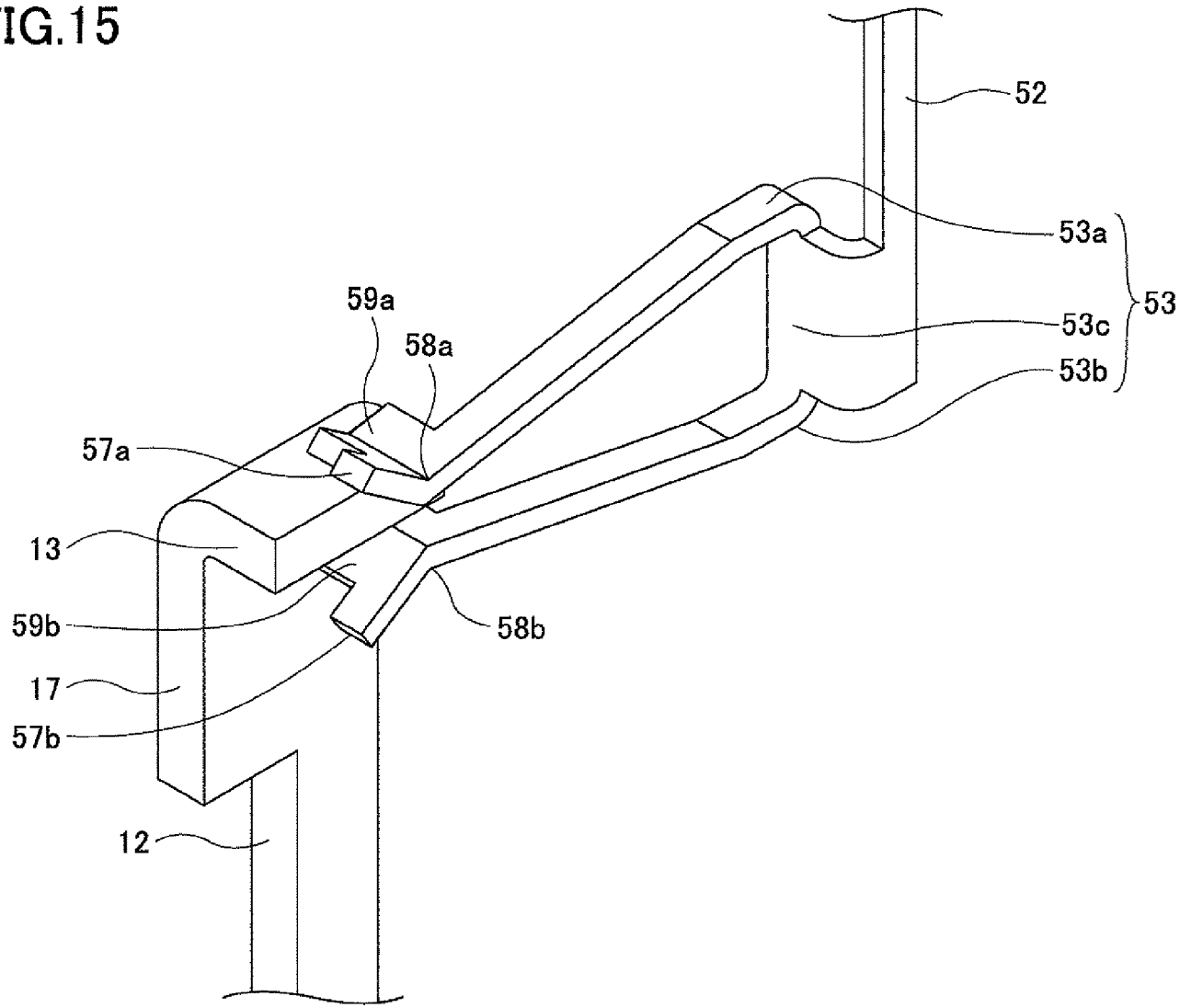
FIG. 15 is a perspective view illustrating the fitting condition of a plug electrode and a jack electrode in a connector device of a third embodiment of the invention.
Figure 16:
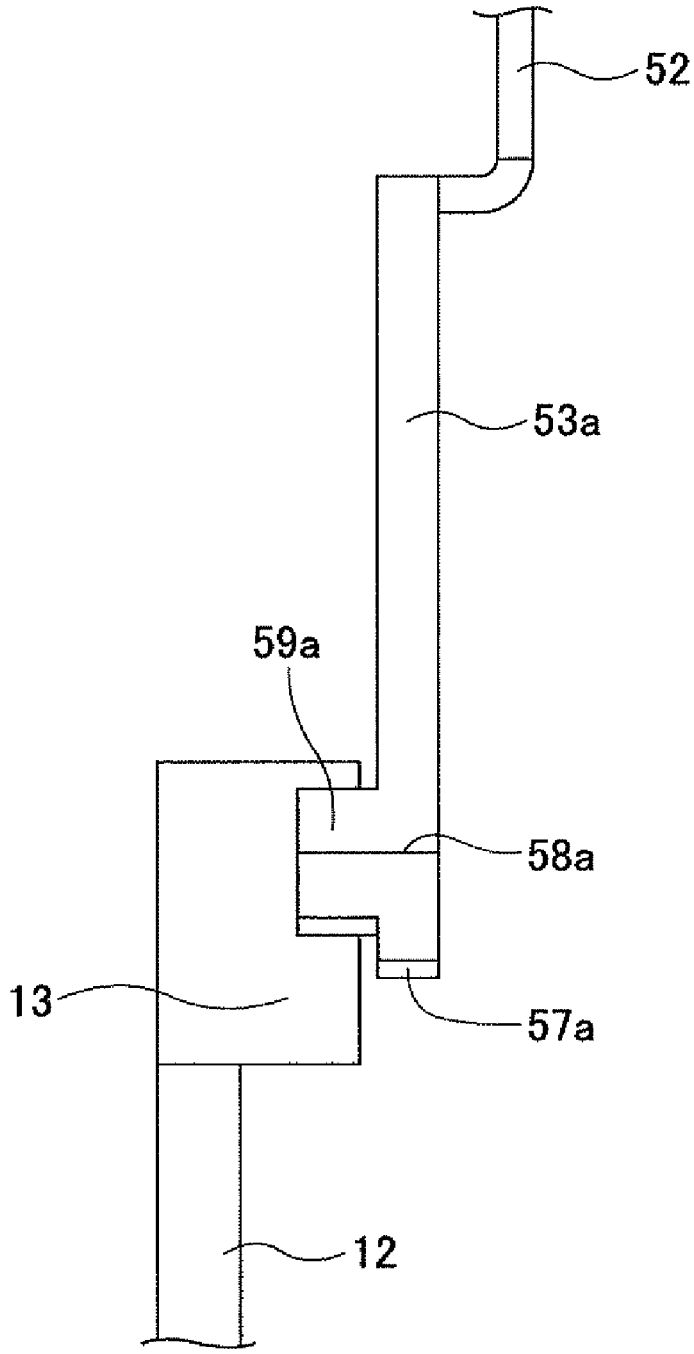
FIG. 16 is a top view illustrating the fitting condition of the plug electrode and the jack electrode in the third embodiment.
Figure 17:
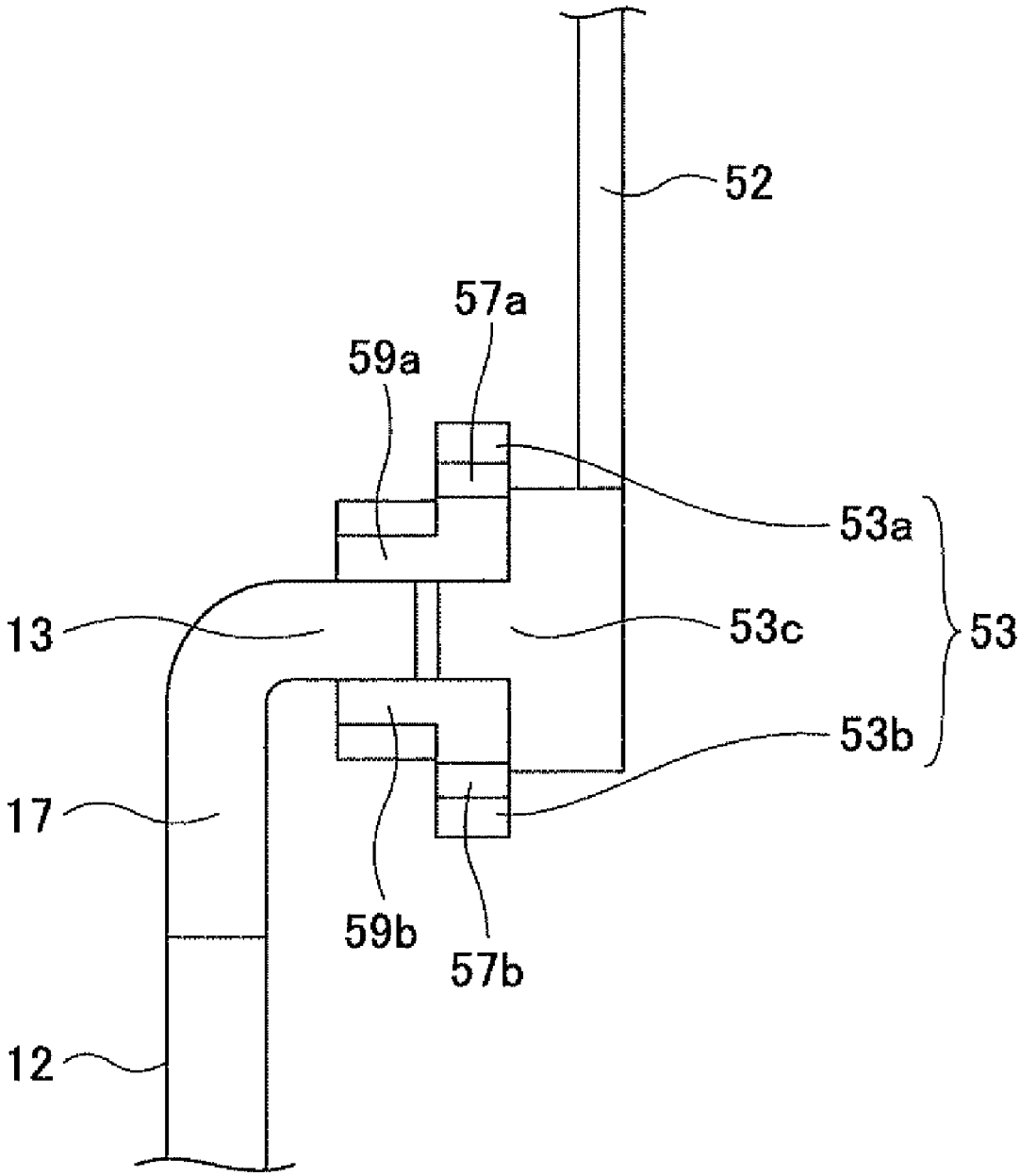
FIG. 17 is a front view illustrating the fitting condition of the plug electrode and the jack electrode in the third embodiment.

With reference to FIGS. 15 to 17, the female connector in this embodiment will be described. Each of the plurality of jack electrodes 52 of the female connector in this embodiment is formed of a conductive material, such as a metal. Each jack electrode 52 includes a connection part 53 formed at one end thereof, and a connection terminal formed at the other end thereof (not illustrated).

The connection part 53 of each jack electrode 52 includes a support portion 53*c* from which two terminal portions 53*a* and 53*b* project in a bifurcated manner, and the terminal portions 53*a* and 53*b* project from the support portion 53*c* in the attaching or detaching direction C, similar to those in the first embodiment.

Both the terminal portion 53*a* and the terminal portion 53*b* are resilient, and when an external force is exerted, the internal gap between the terminal portion 53*a* and the terminal portion 53*b* is easily increased by the external force. Both end portions 57*a* and 57*b* of the terminal portions 53*a* and 53*b* are outwardly curved so that the curved part 13 of each plug electrode 12 of the male connector can be easily inserted in the internal gap between the terminal portion 53*a* and the terminal portion 53*b* via the outwardly curved end portions 57*a* and 57*b*.

The terminal portion 53*a* and the terminal portion 53*b* include a contact part 58*a* and a contact part 58*b*, respectively, where the internal gap between the terminal portion 53*a* and the terminal portion 53*b* is narrowed. The terminal portion 53*a* and the terminal portion 53*b* are formed with a projection 59*a* at the contact part 58*a* and a projection 59*b* at the contact part 58*b*, respectively, where the contact part 58*a* with the projection 59*a* and the contact part 58*b* with the projection 59*b* constitute respective wide portions. Each of the projections 59*a* and 59*b* is formed to project laterally toward the side of the wide part 17 of each plug electrode 12 in which the curved part 13 is formed. Thereby, each jack electrode 52 of the female connector in this embodiment is arranged so that the curved part 13 of each plug electrode 12 can easily pass through the neighborhood of the support portion 53*c*, without forming a groove in the support portion 53*c* as illustrated in the first embodiment. Accordingly, the curved part 13 of each plug electrode 12 can easily pass through the internal gap between the terminal portion 53*a* and the terminal portion 53*b* bi-directionally.

Other compositions of this embodiment than those described above are the same as those of the first embodiment, and a description thereof will be omitted.

Next, a connector device of a fourth embodiment of the invention will be described.

The connector device of this embodiment differs from that of the first embodiment in that the fitting part of each plug electrode of a male connector and the fitting part of each jack electrode of a female connector are rotated by 90 degrees.

Figure 18:
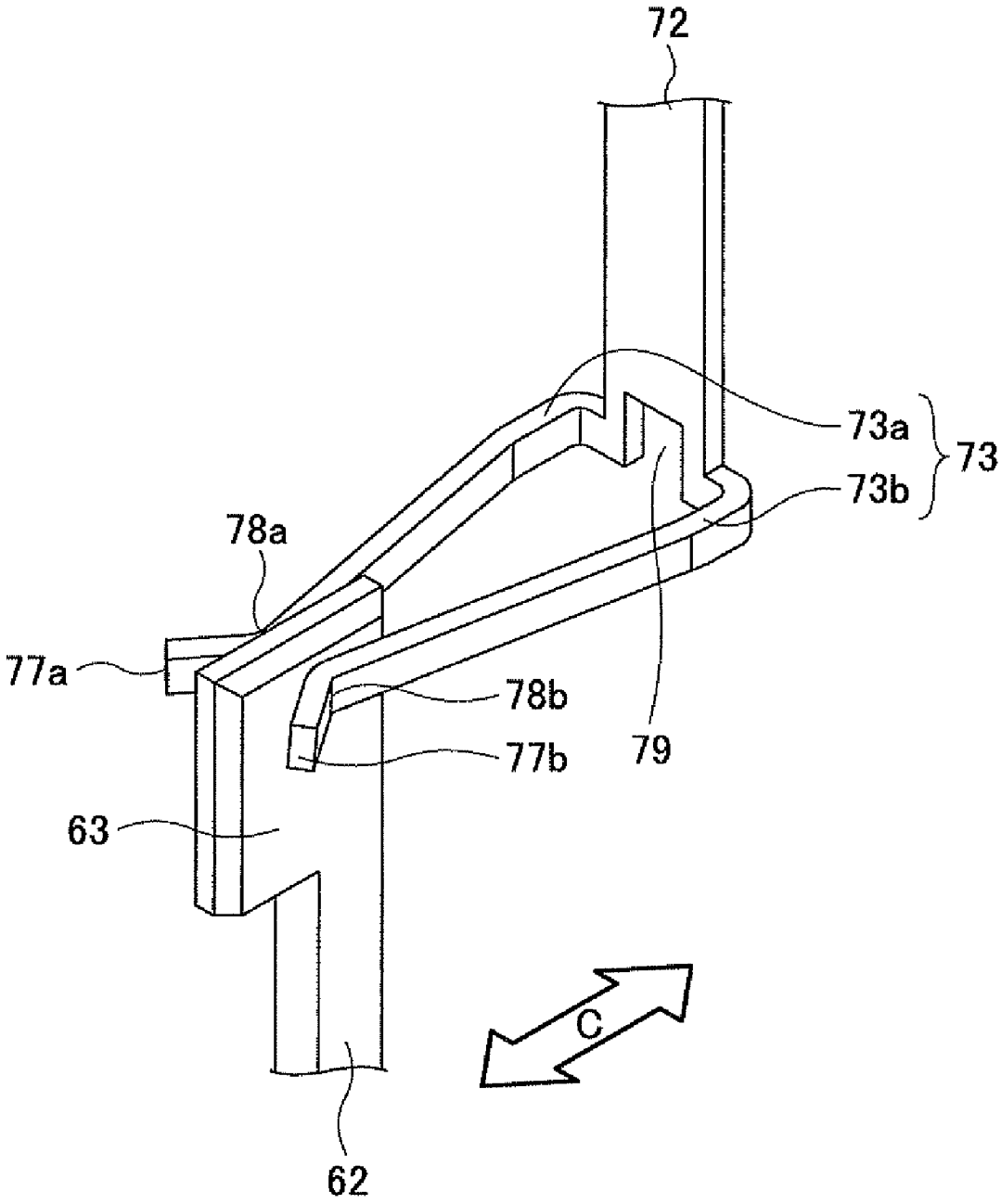
FIG. 18 is a perspective view illustrating the fitting condition of a plug electrode and a jack electrode in a connector device of a fourth embodiment of the invention.
Figure 19:
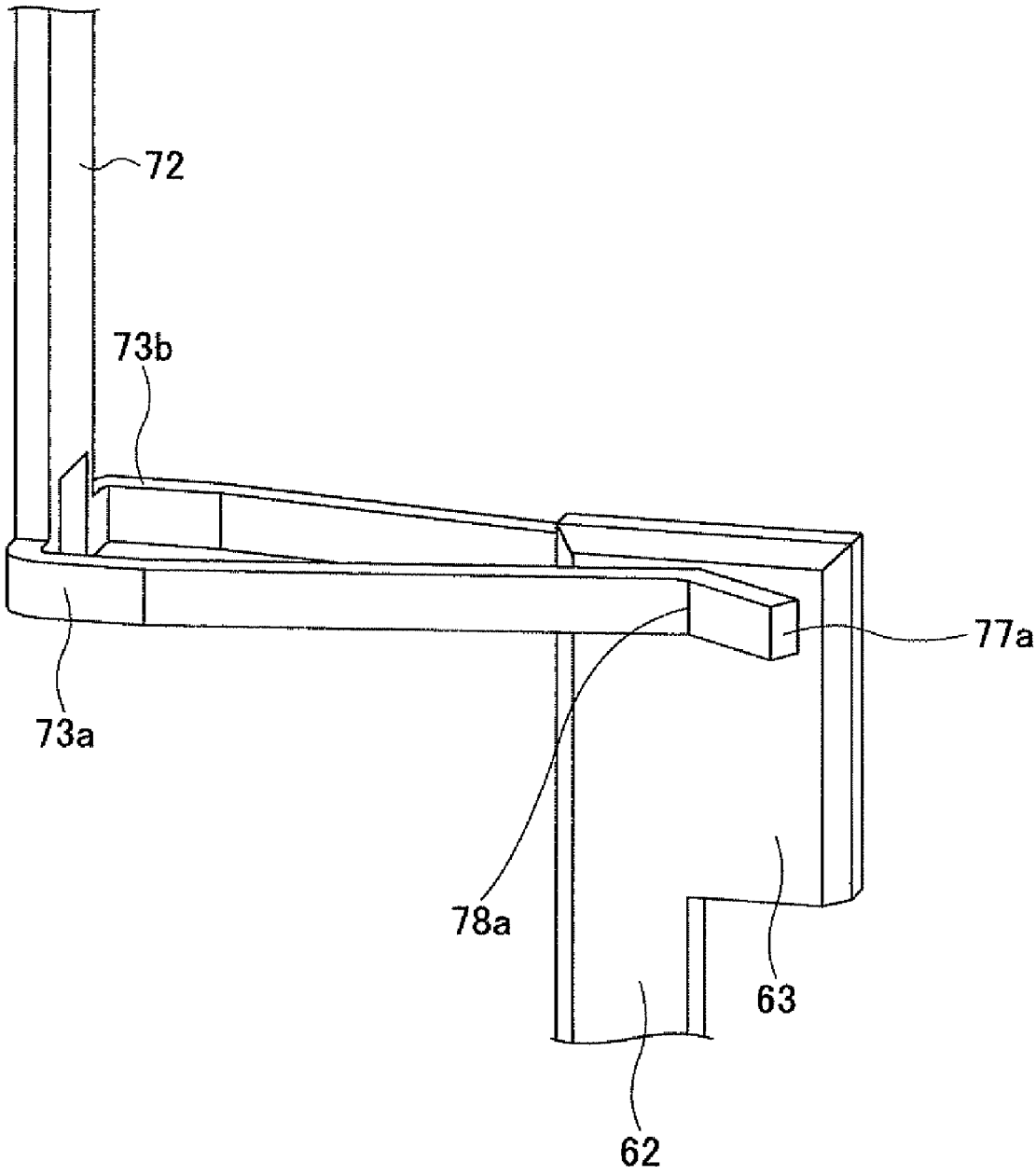
FIG. 19 is a perspective view illustrating the fitting condition of the plug electrode and the jack electrode in the fourth embodiment.
Figure 20:
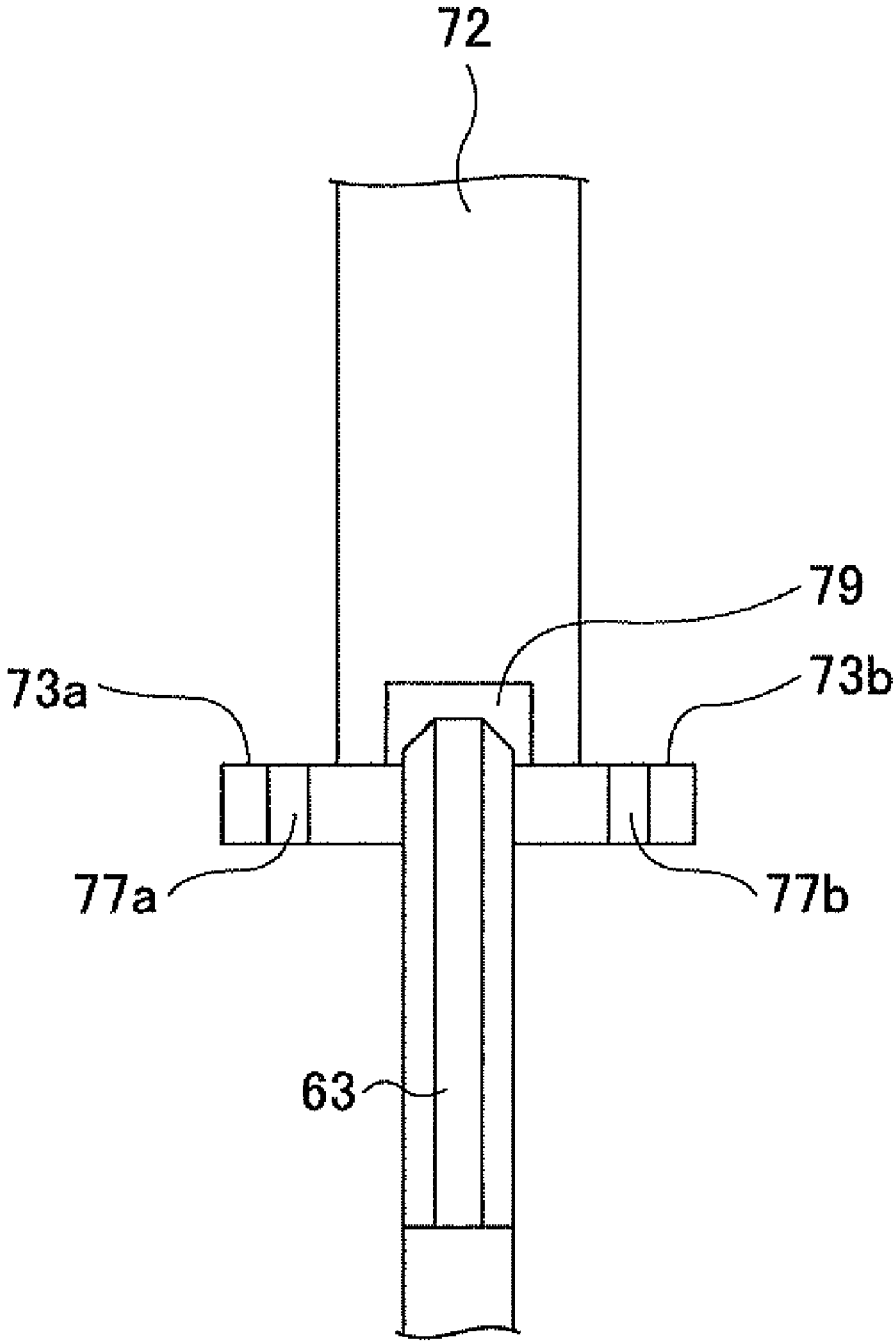
FIG. 20 is a front view illustrating the fitting condition of the plug electrode and the jack electrode in the fourth embodiment.

With reference to FIGS. 18 to 20, the connector device of this embodiment will be described. Each of the plurality of plug electrodes 62 of the male connector in this embodiment is formed of a conductive material, such as a metal. Each plug electrode 62 includes a wide contact part 63 formed at one end thereof, and a connection terminal formed at the other end thereof (not illustrated).

The plurality of plug electrodes 62 inside the body part are in an upright position that is substantially perpendicular to the substrate (not illustrated), and arrayed in a row in an arraying direction that is perpendicular to the attaching or detaching direction indicated by the arrow C.

The wide contact part 63 of each plug electrode 62 is formed such that the width of the wide contact part 63 is larger than the widths of other portions of the plug electrode 62. Thereby, even when the male connector and the female connector are positioned with a slight deviation, the plug electrodes 62 of the male connector and the jack electrodes 72 of the female connector can be electrically connected to each other securely.

Each of the plurality of jack electrodes 72 of the female connector in this embodiment is formed of a conductive material, such as a metal. Each jack electrode 72 includes a connection part 73 formed at one end thereof, and a connection terminal formed at the other end thereof (not illustrated).

The connection part 73 of each jack electrode 72 includes a support portion from which two terminal portions 73*a* and 73*b* project in a bifurcated manner, and the terminal portions 73*a* and 73*b* are bent from the support portion in the attaching or detaching direction indicated by the arrow C.

Both the terminal portion 73*a* and the terminal portion 73*b* are resilient, and when an external force is exerted, the internal gap between the terminal portion 73*a* and the terminal portion 73*b* is easily increased by the external force. Both end portions 77*a* and 77*b* of the terminal portions 73*a* and 73*b* are outwardly curved so that the wide contact part 63 of each plug electrode 62 of the male connector can be easily inserted in the internal gap between the terminal portions 73*a* and 73*b* via the outwardly curved end portions 77*a* and 77*b*.

The terminal portion 73*a* and the terminal portion 73*b* include a contact part 78*a* and a contact part 78*b*, respectively, where the internal gap between the terminal portion 73*a* and the terminal portion 73*b* is narrowed.

The connection part 73 of each jack electrode 72 in this embodiment is arranged to make the fitting part (the terminal portions 73*a* and 73*b*) of the connection part 73 define a horizontal surface by rotating the fitting part of the connection part 23 as in the first embodiment by 90 degrees around the horizontal axis (which is parallel to the attaching or detaching direction C). The wide contact part 63 of each plug electrode 62 in this embodiment is arranged to make the fitting part of the wide contact part 63 define a vertical surface by rotating the curved part 13 as in the first embodiment by 90 degrees around the horizontal axis (which is parallel to the attaching or detaching direction C).

When fitting the female connector in the male connector in this embodiment, the female connector is slid relative to the male connector in the direction C, and the wide contact part 63 of each plug electrode 62 of the male connector is inserted in the internal gap between the terminal portion 73*a* and the terminal portion 73*b* via the outwardly curved end portions 77*a* and 77*b* of each jack electrode 72 of the female connector. In the terminal portions 73*a* and 73*b*, the contact parts 78*a* and 78*b* where the internal gap is narrowed are provided, and the wide part 73 of the plug electrode 62 is fitted between the contact parts 78*a* and 78*b* and contacted thereto, so that the plug electrode 62 and the jack electrode 72 are electrically connected to each other.

Subsequently, if the female connector is further slid relative to the male connector, the wide contact part 63 of the plug electrode 62 passes through the internal gap between the terminal portion 73*a* and the terminal portion 73*b* and passes through a recess 79 formed in the jack electrode 72, so that the wide contact part 63 of the plug electrode 62 is disconnected from the connection part 73 of the jack electrode 72.

When fitting the female connector in the male connector again, the female connector is slid relative to the male connector in the reverse direction that is opposite to the above-mentioned direction C, and the wide contact part 63 of the plug electrode 62 is inserted in the internal gap between the terminal portions 73*a* and 73*b* via the recess 79. In this case, if the female connector is further slid backward relative to the male connector, the wide contact part 63 of the plug electrode 62 may be fitted in the contact parts 78*a* and 78*b* of the jack electrode 72 and contacted thereto. Thereby, the plug electrode 62 and the jack electrode 72 can be connected electrically.

Other compositions of this embodiment than those described above are the same as those of the first embodiment, and a description thereof will be omitted. In this embodiment, it is not necessary to form a curved part in the plug electrode 62, the time and effort needed for machining the plug electrode 62 and the jack electrode 72 can be reduced, and the connector device including the male connector and the female connector can be manufactured with a low cost.

Next, a connector device of a fifth embodiment of the invention will be described.

The male connector in the connector device of this embodiment is the same as that of the fourth embodiment, and the composition of the jack electrodes of the female connector in this embodiment differs from that in the fourth embodiment.

Figure 21:
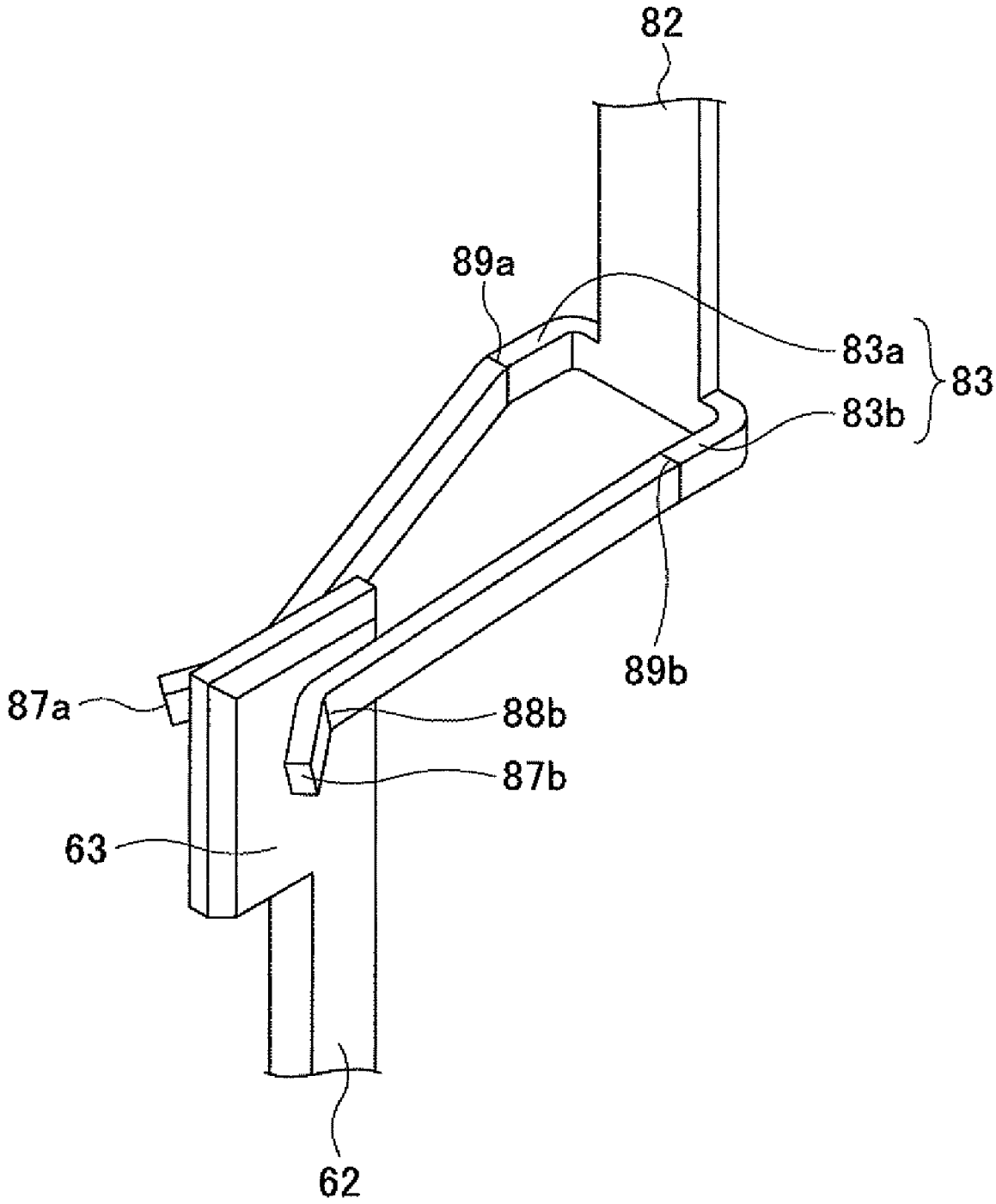
FIG. 21 is a perspective view illustrating the fitting condition of a plug electrode and a jack electrode in a connector device of a fifth embodiment of the invention.
Figure 22:
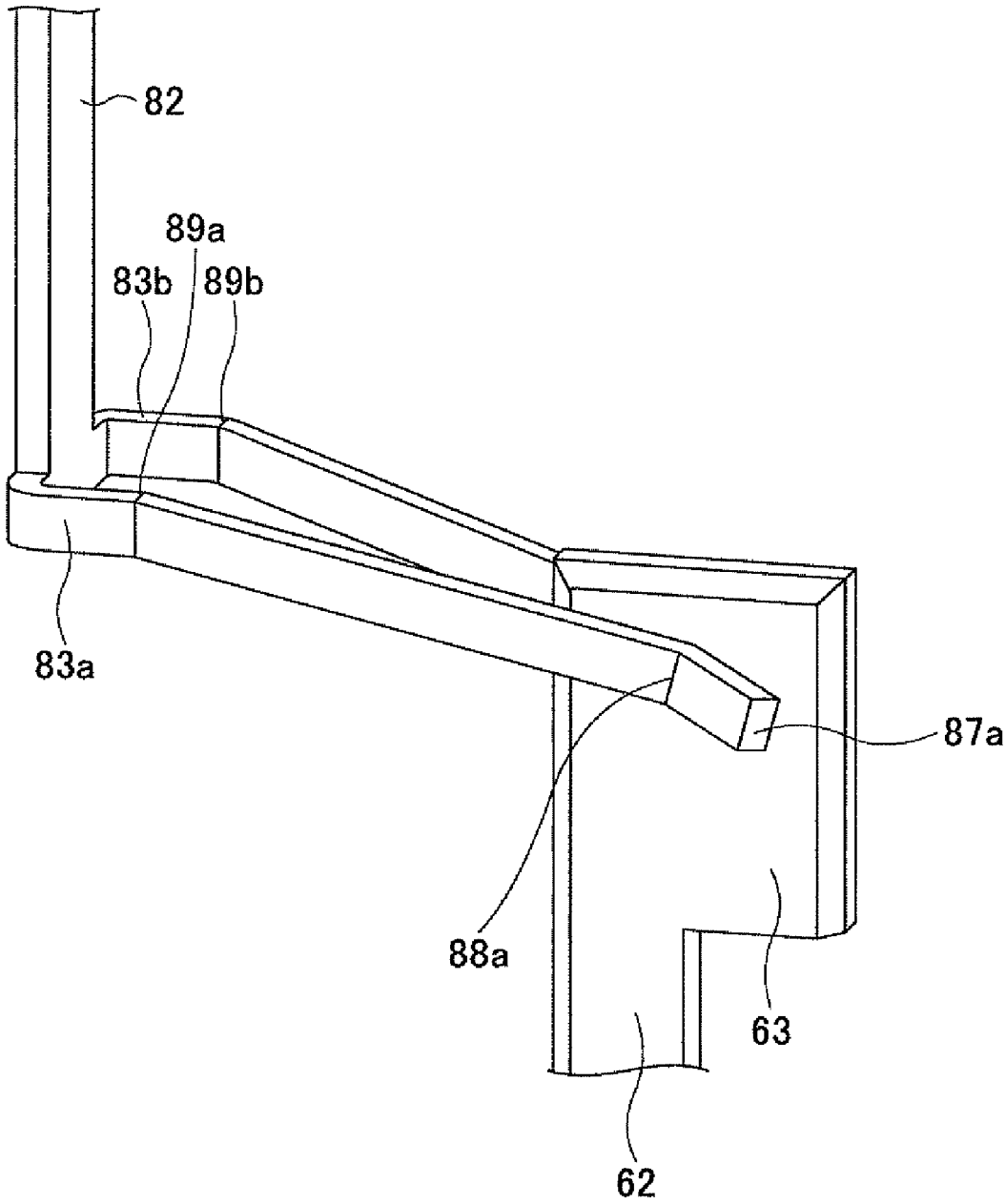
FIG. 22 is a perspective view illustrating the fitting condition of the plug electrode and the jack electrode in the fifth embodiment.
Figure 23:
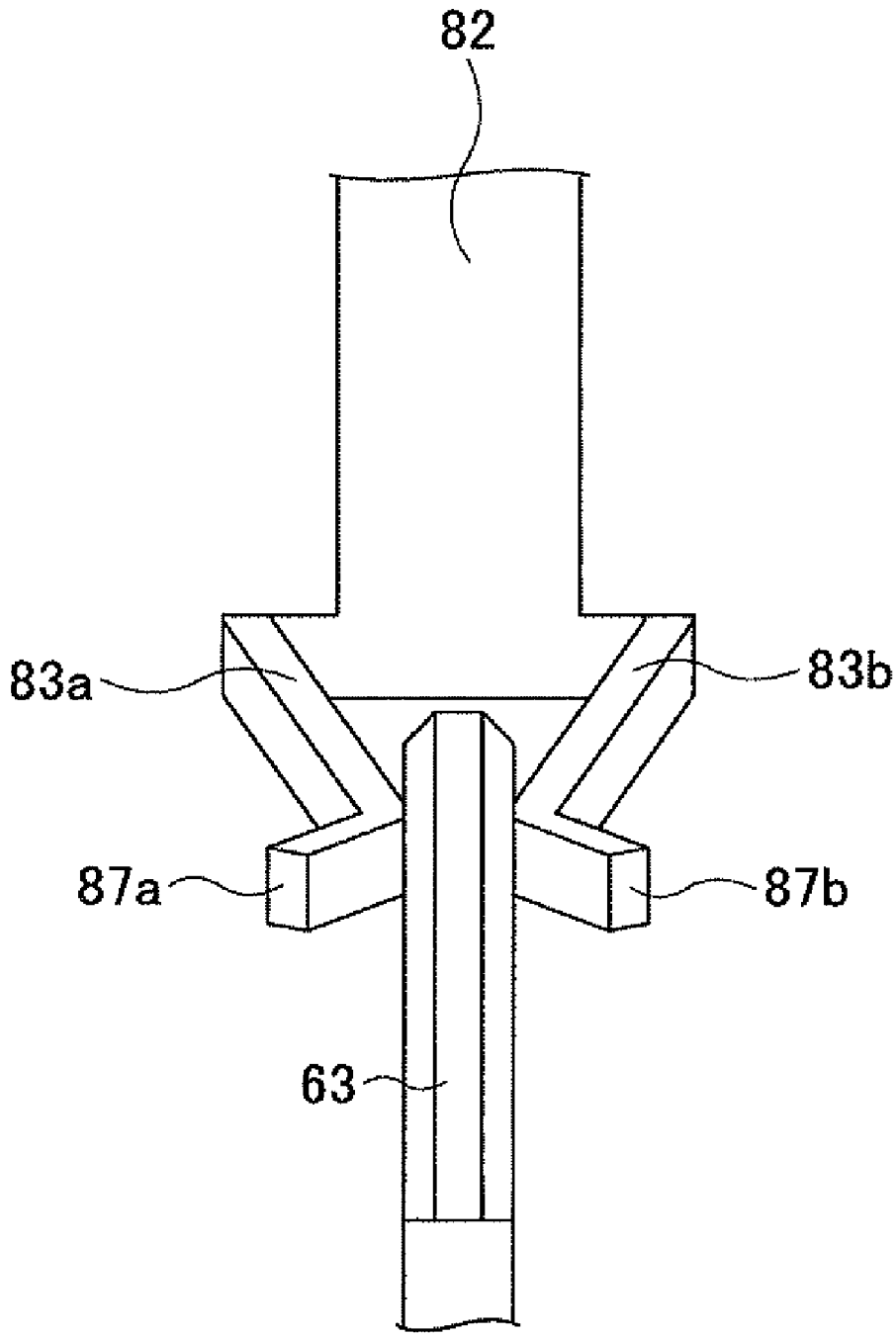
FIG. 23 is a front view illustrating the fitting condition of the plug electrode and the jack electrode in the fifth embodiment.

With reference to FIGS. 21 to 23, the female connector in this embodiment will be described. Each of the plurality of jack electrodes 82 of the female connector in this embodiment is formed of a conductive material, such as a metal. Each jack electrode 82 includes a connection part 83 formed at one end thereof, and a connection terminal formed at the other end thereof (not illustrated).

The connection part 83 of each jack electrode 82 includes a support portion from which two terminal portions 83*a* and 83*b* project in a bifurcated manner, and the terminal portions 83*a* and 83*b* are bent from the support portion slantingly in the attaching or detaching direction C, similar to those in the fourth embodiment.

Both the terminal portion 83*a* and the terminal portion 83*b* are resilient, and when an external force is exerted, the internal gap between the terminal portion 83*a* and the terminal portion 83*b* is easily increased by the external force. Both end portions 87*a* and 87*b* of the terminal portions 83*a* and 83*b* are outwardly curved so that the wide contact part 63 of each plug electrode 62 of the male connector can be easily inserted in the internal gap between the terminal portion 83*a* and the terminal portion 83*b* via the outwardly curved end portions 87*a* and 87*b*.

The terminal portion 83*a* and the terminal portion 83*b* include a contact part 88*a* and a contact part 88*b*, respectively, where the internal gap between the terminal portion 83*a* and the terminal portion 83*b* is narrowed. The terminal portion 83*a* and the terminal portion 83*b* include a terminal curved part 89*a* and a terminal curved part 89*b*, respectively, where the terminal portion 83*a* and the terminal portion 83*b* are bent inwardly and slantingly toward the side of the wide contact part 63 of the plug electrode 62. Thereby, each jack electrode 82 of the female connector in this embodiment is arranged so that the wide contact part 63 of the plug electrode 62 can easily pass through the internal gap between the terminal portion 83*a* and the terminal portion 83*b* and pass through the support portion of the connection part bi-directionally, without forming a recess 79 as illustrated in the fourth embodiment.

Other compositions of this embodiment than those described above are the same as those of the fourth embodiment, and a description thereof will be omitted.

Next, a connector device of a sixth embodiment of the invention will be described.

The male connector in the connector device of this embodiment is the same as that of the fourth embodiment, and the composition of the jack electrodes of the female connector in this embodiment differs from that in the fourth embodiment.

Figure 24:
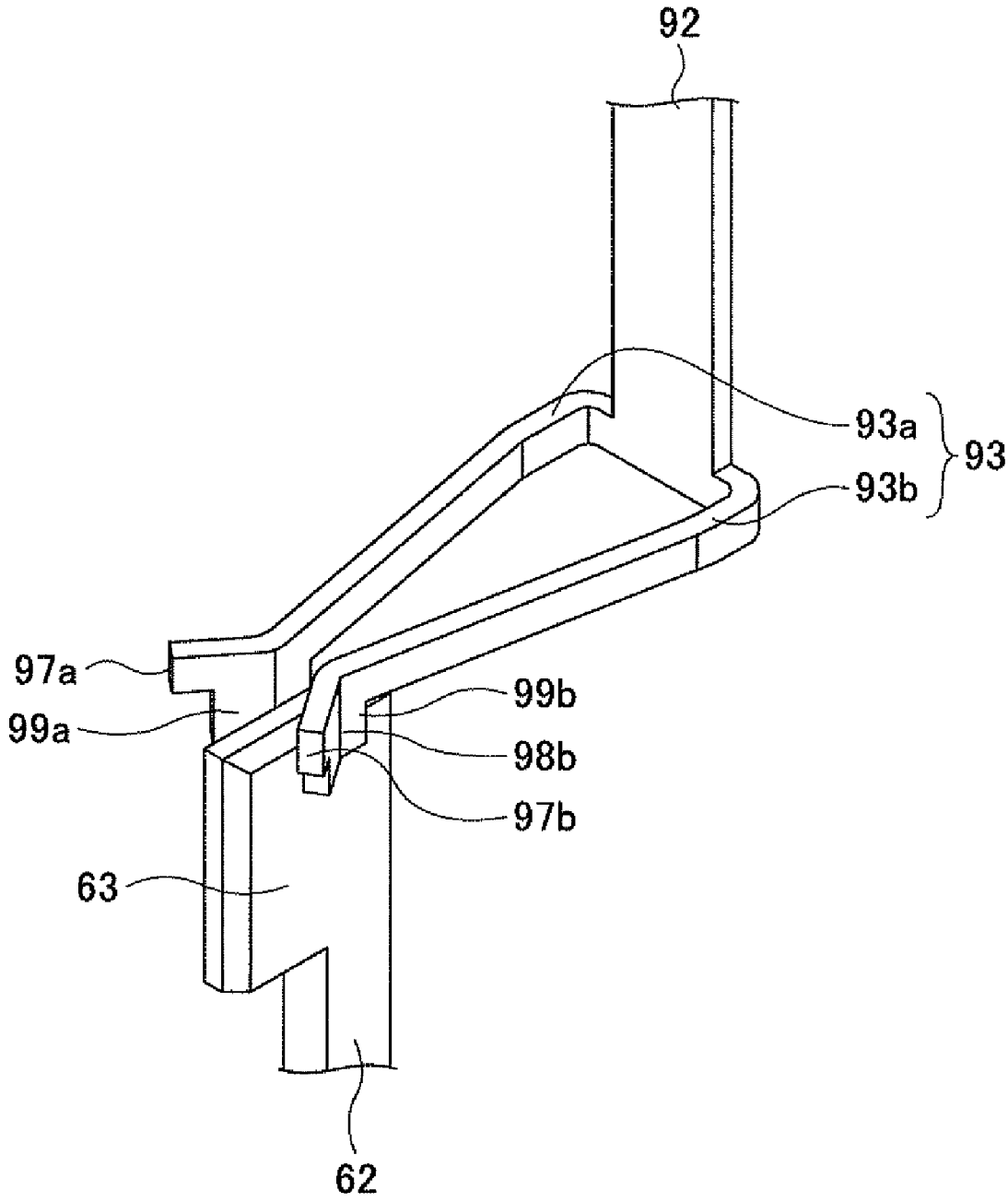
FIG. 24 is a perspective view illustrating the fitting condition of a plug electrode and a jack electrode in a connector device of a sixth embodiment of the invention.
Figure 25:
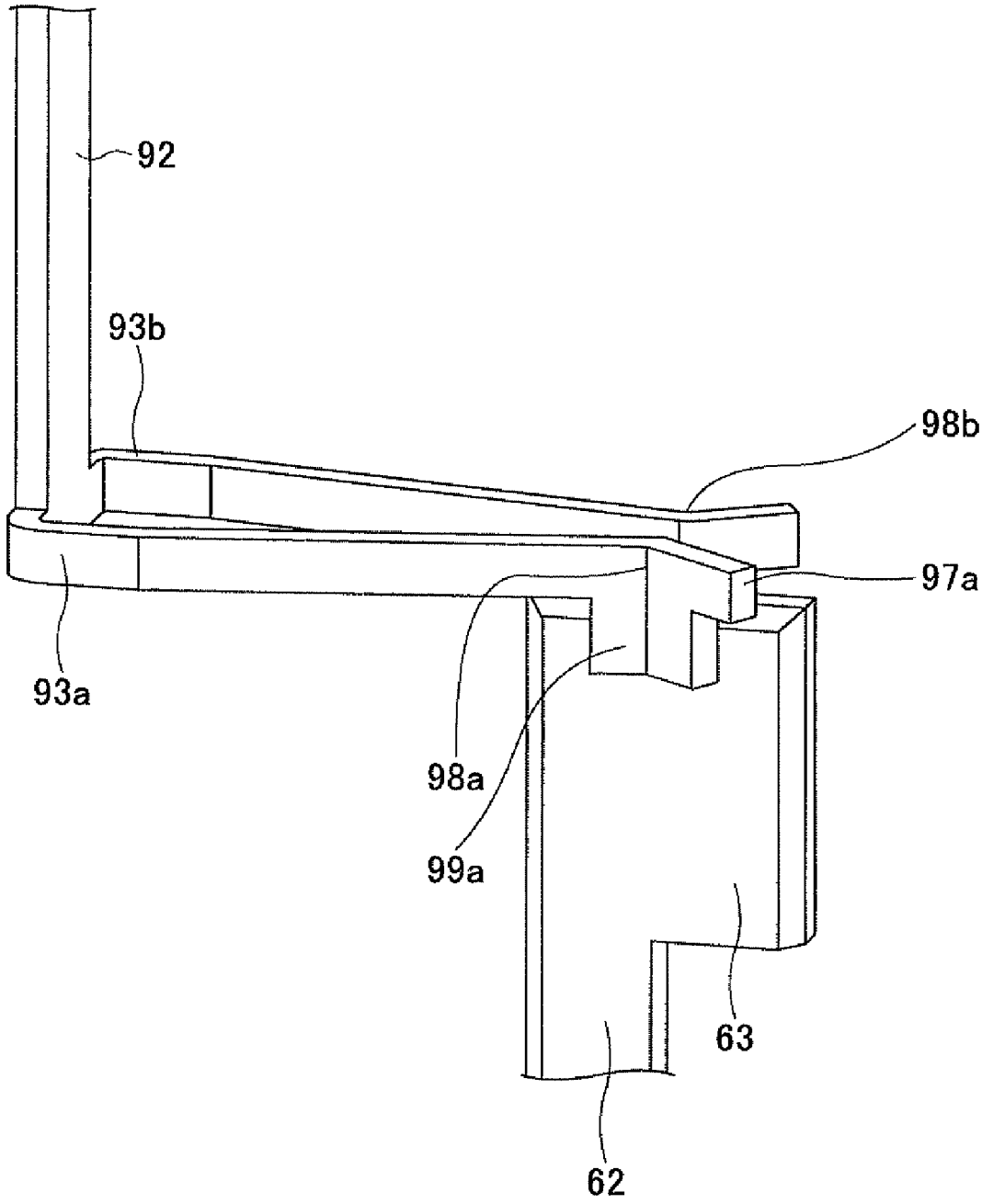
FIG. 25 is a perspective view illustrating the fitting condition of the plug electrode and the jack electrode in the sixth embodiment.
Figure 26:
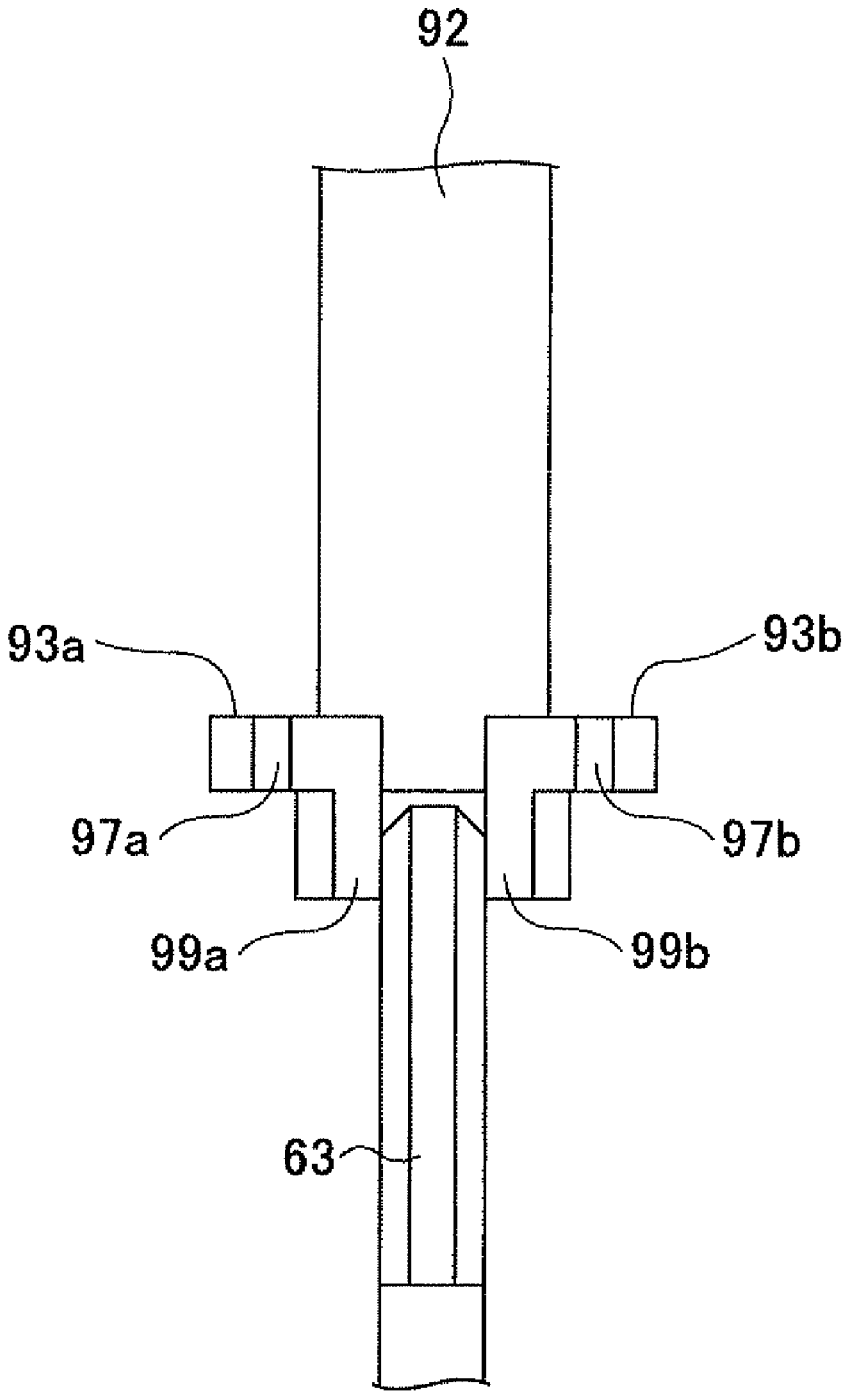
FIG. 26 is a front view illustrating the fitting condition of the plug electrode and the jack electrode in the sixth embodiment.

With reference to FIGS. 24 to 26, the female connector in this embodiment will be described. Each of the plurality of jack electrodes 92 of the female connector in this embodiment is formed of a conductive material, such as a metal. Each jack electrode 92 includes a connection part 93 formed at one end thereof, and a connection terminal formed at the other end thereof (not illustrated).

The connection part 93 of each jack electrode 92 includes a support portion from which two terminal portions 93*a* and 93*b* project in a bifurcated manner, and the terminal portions 93*a* and 93*b* are bent from the support portion in the attaching or detaching direction C, similar to those in the fourth embodiment.

Both the terminal portion 93*a* and the terminal portion 93*b* are resilient, and when an external force is exerted, the internal gap between the terminal portion 93*a* and the terminal portion 93*b* is easily increased by the external force. Both end portions 97*a* and 97*b* of the terminal portions 93*a* and 93*b* are outwardly curved so that the wide contact part 63 of each plug electrode 62 of the male connector can be easily inserted in the internal gap between the terminal portion 93*a* and the terminal portion 93*b* via the outwardly curved end portions 97*a* and 97*b*.

The terminal portion 93*a* and the terminal portion 93*b* include a contact part 98*a* and a contact part 98*b*, respectively, where the internal gap between the terminal portion 93*a* and the terminal portion 93*b* is narrowed. The terminal portion 93*a* and the terminal portion 93*b* are formed with a projection 99*a* at the contact part 98*a* and a projection 99*b* at the contact part 98*b*, respectively, where the contact part 98*a* with the projection 99*a* and the contact part 98*b* with the projection 99*b* constitute respective wide portions. Each of the projections 99*a* and 99*b* is formed to project laterally toward the side of the wide contact part 63 of each plug electrode 62. Thereby, each jack electrode 92 of the female connector in this embodiment is arranged so that the wide contact part 63 of each plug electrode 62 can easily pass through the internal gap between the terminal portion 93*a* and the terminal portion 93*b* bidirectionally, without forming a recess 79 as illustrated in the fourth embodiment.

Other compositions of this embodiment than those described above are the same as those of the fourth embodiment, and a description thereof will be omitted.

As described in the foregoing, it is possible for the present invention to provide a connector device which is used for connection of PLC units in an electronic device and enables easy replacement of a defective PLC unit in the middle of the PLC unit array, without restricting the number of PLC units arranged in the electronic device.

The present invention is not limited to the specifically disclosed embodiments, and variations and modifications may be made without departing from the scope of the present invention.

The present application is based on Japanese patent application No. 2009-093258, filed on Apr. 7, 2009, the entire contents of which are incorporated herein by reference in their entirety.

What is claimed is:

1. A connector device comprising:

a male connector; and a female connector attached to and detached from the male connector by moving the male connector in a sliding direction relative to the female connector, wherein:

the male connector comprises plug electrodes arrayed in a row extending in an arraying direction perpendicular to the sliding direction, each plug electrode including a curved part formed at one end of the plug electrode and bent in the arraying direction;

the female connector comprises jack electrodes arrayed in a row extending in the arraying direction, each jack electrode including a connection part formed at one end of the jack electrode and projecting in a direction parallel to the sliding direction, each connection part including a support portion and a pair of resilient terminal portions projecting from the support portion in a bifurcated manner; and when the male connector and the female connector are mutually fitted to each other, the curved part of each plug electrode is inserted and fitted between the pair of resilient terminal portions of a corresponding one of the jack electrodes.

2. The connector device according to claim 1, wherein the support portion includes a groove formed therein, and the curved part of each plug electrode passes through the groove when the male connector and the female connector are mutually slid in the sliding direction.

3. The connector device according to claim 1, wherein the pair of resilient terminal portions are bent inwardly and slantingly toward a corresponding one of the plug electrodes, and the curved part passes through a vicinity of the support portion when the male connector and the female connector are mutually slid.

4. The connector device according to claim 1, wherein the pair of resilient terminal portions are formed with respective projections which project laterally toward a corresponding one of the plug electrodes, and the curved part passes through a vicinity of the support portion when the male connector and the female connector are mutually slid.

5. A connector device comprising:

a male connector; and a female connector attached to and detached from the male connector by moving the male connector in a sliding direction relative to the female connector, wherein:

the male connector comprises a plurality of plug electrodes arrayed in a row extending in an arraying direction perpendicular to the sliding direction, each plug electrode including a contact part formed at one end of the plug electrode;

the female connector comprises:

a plurality of jack electrodes arrayed in a row extending in the arraying direction, each jack electrode includes a connection part formed at one end of the jack electrode, each connection part including a support portion and a pair of resilient terminal portions projecting in a direction parallel to the sliding direction from the support portion in a bifurcated manner; and a first body part of an insulating material in which the plurality of jack electrodes are press fitted, the first body part being divided into a first part and a second part which are coupled together by the plurality of jack electrodes, an end of each jack electrode of the female connector located in the second part being connectable with a substrate, and an end of each jack electrode of the female connector located in the first part being connected to corresponding one of the plurality of plug electrodes of the male connector; and when the male connector and the female connector are mutually fitted to each other, the contact part of each plug electrode is inserted and fitted between the pair of resilient terminal portions of a corresponding one of the jack electrodes, wherein each support portion includes a recess formed therein, and each contact part passes through the recess when the male connector and the female connector are mutually slid.

6. The connector device according to claim 5, wherein each of the pair of resilient terminal portions is bent inwardly and slantingly toward the corresponding one of the plug electrodes, and each contact part passes through a vicinity of the support portion when the male connector and the female connector are mutually slid.

7. The connector device according to claim 5, wherein each of the pair of resilient terminal portions is formed with a projection projecting laterally toward the corresponding one of the plug electrodes, and each contact part passes through a vicinity of the support portion when the male connector and the female connector are mutually slid.

8. The connector device according to claim 5, wherein:

the jack electrodes are press fitted to the first body part, the jack electrodes being covered by the insulating material forming the first body part; and the male connector includes a second body part of the insulating material in which the plug electrodes are press fitted, the plug electrodes being covered by the insulating material forming the second body part.

9. The connector device according to claim 5, wherein:

the jack electrodes extend toward a direction perpendicular to both the sliding direction and the arraying direction; and the other end of each jack electrode opposite to the one end where the connection part is formed is connected with a substrate.

10. The connector device according to claim 5, wherein:

the first body part includes, at its one end, slits arrayed in the arraying direction in which the contact part of each plug electrode passes through a corresponding one of the slits when the male connector is moved in the sliding direction relative to the female connector.

11. The connector device according to claim 10, wherein:

the pair of resilient terminal portions are provided within one of the slits so as to cover the pair of resilient terminal portions by the first body part.

12. A connector attached to and detached from another connector, the other connector including a plurality of plug electrodes arrayed in a row, by sliding the connector in a sliding direction relative to the other connector, the connector comprising:

a plurality of jack electrodes each including a connection part formed at one end of the jack electrode to be connected to a corresponding one of the plurality of plug electrodes, the connection part including a support portion and a pair of resilient terminal portions projecting in a direction parallel to the sliding direction from the support portion;

an insulating part in which the plurality of jack electrodes are press fitted, the insulating part being divided into a first part and a second part which are coupled together by the plurality of jack electrodes, an end of each jack electrode located in the second part being connectable with a substrate, and an end of each jack electrode located in the first part being connected to corresponding one of the plurality of plug electrodes of the other connector, wherein each support portion includes a recess formed therein, and each contact part passes through the recess when the connector and the other connector are mutually slid.

* * * * *